US012565878B2

(12) United States Patent
Collins

(10) Patent No.: US 12,565,878 B2
(45) Date of Patent: Mar. 3, 2026

(54) RADIAL PISTON PUMPS

(71) Applicant: DOMIN FLUID POWER LIMITED, Bristol (GB)

(72) Inventor: Andrew Collins, Bristol (GB)

(73) Assignee: DOMIN FLUID POWER LIMITED, Bristol (GB)

( * ) Notice: Subject to any disclaimer, the term of this patent is extended or adjusted under 35 U.S.C. 154(b) by 97 days.

(21) Appl. No.: 18/558,008

(22) PCT Filed: May 5, 2022

(86) PCT No.: PCT/GB2022/051148

§ 371 (c)(1),
(2) Date: Oct. 30, 2023

(87) PCT Pub. No.: WO2022/234284

PCT Pub. Date: Nov. 10, 2022

(65) Prior Publication Data

US 2024/0209854 A1 Jun. 27, 2024

(30) Foreign Application Priority Data

May 6, 2021 (GB) ..... 2106490
May 6, 2021 (GB) ..... 2106491
May 6, 2021 (GB) ..... 2106493

(51) Int. Cl.
*F04B 9/04* (2006.01)
*F04B 1/0456* (2020.01)
(Continued)

(52) U.S. Cl.
CPC ..... *F04B 9/042* (2013.01); *F04B 1/0456* (2013.01); *F04B 1/0476* (2013.01); *F04B 1/1071* (2013.01); *F04B 49/007* (2013.01)

(58) Field of Classification Search
CPC .... F04B 1/0456; F04B 1/0476; F04B 1/1071; F04B 9/042; F04B 49/007
See application file for complete search history.

(56) References Cited

U.S. PATENT DOCUMENTS 4,532,854 A * 8/1985 Foster ..... F03C 1/045 91/472
4,569,630 A * 2/1986 Eickmann ..... F03C 1/0406 91/499
(Continued)

FOREIGN PATENT DOCUMENTS

DE 102017128098 A1 5/2019
DE 102018006981 A1 3/2020
(Continued)

OTHER PUBLICATIONS

GB Search Report corresponding to Application No. GB2106490.2, dated Oct. 8, 2021, 3 pages.
(Continued)

*Primary Examiner* — Bryan M Lettman
(74) *Attorney, Agent, or Firm* — Day Pitney LLP; George Chaclas; Anthony A. Kassas

(57) ABSTRACT

A radial piston pump comprising a rotor mounted for rotation on a pintle. The rotor comprises a plurality of piston chambers, a piston being mounted in each of said chambers for reciprocal movement. The pump comprises at least one auxiliary flow path which connects another component of the pump to the piston chambers. The pintle comprises a plurality of flow galleries comprising at least one supply flow gallery forming part of a supply flow path, at least one exit flow gallery forming part of an exit flow path and at least one auxiliary flow gallery forming part of the auxiliary flow path.

21 Claims, 14 Drawing Sheets

(51) Int. Cl.

| | |
|---|---|
| ***F04B 1/0476*** | (2020.01) |
| ***F04B 1/1071*** | (2020.01) |
| ***F04B 49/00*** | (2006.01) |

(56) References Cited

U.S. PATENT DOCUMENTS

| | | | | |
|---|---|---|---|---|
| 4,930,994 | A | 6/1990 | Budecker | |
| 5,167,493 | A * | 12/1992 | Kobari | F04B 1/0536 417/427 |
| 2011/0268596 | A1* | 11/2011 | Hansen | F04B 1/07 418/31 |
| 2017/0138335 | A1* | 5/2017 | Becher | F03C 1/0438 |
| 2017/0306936 | A1 | 10/2017 | Dole et al. | |
| 2018/0202421 | A1* | 7/2018 | Collins | F04B 1/0439 |
| 2018/0245573 | A1* | 8/2018 | Maruo | B60T 13/662 |
| 2020/0195113 | A1* | 6/2020 | Nieuwenhuis | F04B 17/03 |

FOREIGN PATENT DOCUMENTS

| | | | |
|---|---|---|---|
| EP | 2921700 | A1 | 9/2015 |
| GB | 1533527 | * | 2/1977 |
| GB | 1533527 | A | 11/1978 |
| GB | 2042064 | A1 | 9/1980 |
| GB | 2132707 | B2 | 8/1986 |
| JP | H02108866 | A | 4/1990 |
| JP | H04187871 | A2 | 7/1992 |
| WO | 1983002482 | A1 | 7/1983 |
| WO | 1991019902 | A1 | 12/1991 |
| WO | 2016198793 | A1 | 12/2016 |
| WO | 2017011303 | A1 | 1/2017 |
| WO | 2017098250 | A1 | 6/2017 |
| WO | 2021034642 | A1 | 2/2021 |

OTHER PUBLICATIONS

GB Search Report corresponding to Application No. GB2106491.0, dated Oct. 8, 2021, 7 pages.

International Search Report and Written Opinion corresponding to Application No. PCT/GB2022/051148, dated Oct. 21, 2022, 22 pages.

GB Search Report corresponding to Application No. GB2106493.6, dated Oct. 11, 2021, 5 pages.

* cited by examiner

RADIAL PISTON PUMPS

CROSS-REFERENCED APPLICATIONS

The present application is a U.S. National Stage Application of International Application No. PCT/GB2022/051148 filed May 5, 2022 and published on Nov. 10, 2022 as WO 2022/234284 A1, which claims the benefit and priority of Great Britain Patent Application No. 2106490.2 filed May 6, 2021 and Great Britain Patent Application No. 2106491.0 filed May 6, 2021 and Great Britain Patent Application No. 2106493.6, each of which is incorporated herein by reference in its entirety for any purpose whatsoever.

FIELD OF THE DISCLOSURE

The present disclosure concerns radial piston pumps. More particularly, but not exclusively, this disclosure concerns radial piston pumps having a first set of pistons and a second set of pistons and a valve configured to control the flow of fluid to or from both the first set of pistons and the second set of pistons. In another aspect, the disclosure concerns a radial piston pump having a common rotor as between the motor and the pump. In yet another aspect, the disclosure concerns a radial piston pump having a pintle comprising at least one auxiliary flow gallery. The disclosure also concerns a hydraulic power pack, a brake system, an active suspension system and/or a flight control system including such radial piston pumps, methods of operating such piston pumps, and methods of manufacturing such piston pumps.

BACKGROUND

Radial piston pumps are used in a wide variety of applications including automotive and aerospace applications.

Typically radial piston pumps comprise a plurality of pistons mounted in radially extending piston chambers formed in a piston housing. The piston housing may include a hollow centre with a shaft mounted eccentrically therein. Alternatively, the piston housing may be eccentrically mounted within a ring. Movement of the pistons may be produced by rotating the piston housing relative to the shaft and/or ring. An inside (or internally) impinged pump may be defined as a pump in which the fluid flows into the pistons via the interior of the pump housing. An outside (or externally) impinged pump may be defined as a pump in which the fluid flows to and from the pistons via structure located around the exterior of the piston housing.

FIG. 1 shows a schematic view of a prior art inside impinged radial piston pump 1001. The pump 1001 comprises a cylindrical piston housing 1002 including a plurality of radially extending piston chambers 1018 formed in the body of the housing 1002. A piston 1020 that forms part of a piston assembly 1019 is located in each piston chamber 1018. Each piston assembly 1019 includes a piston 1020 and a cam follower 1022 connected to the piston 1020. The cam follower 1022 is in contact with an inward facing cam surface 1024 that extends around the outside of the piston housing 1002. The radius of the cam surface 1024 varies periodically with distance around the perimeter of the housing 1002.

In use, the piston housing 1002 rotates relative to the cam surface 1024. A spring (not shown) urges the piston 1020 radially outward from the piston chamber 1018 and accordingly maintains the cam follower 1022 in contact with the cam surface 1024. In some prior art pumps a spring is not required and centrifugal force, or the pressure of liquid flowing into the piston chamber 1018 may be sufficient to maintain the follower in contact with the cam surface 1024. Along portions of the cam surface 1024 where the radius of the cam surface reduces with the relative rotation of the housing 1002 and cam surface 1024 the piston 1020 is pushed into the piston chamber 1018 as a result of the contact between the cam follower 1022 and the cam surface 1024. Consequently, any liquid located in the piston chamber 1018 is expelled from the piston chamber 1018 under pressure. Conversely, when the profile of the cam surface 1024 is such that the radius of the cam surface 1024 increases with rotation the piston 1020 moves radially outward and fluid can enter the piston chamber 1018. Thus, rotation of the piston housing 1002 relative to the varying profile of the cam surface 1024 causes the pistons 120 to reciprocate in the piston chambers 1018 thereby moving fluid through the pump 1001. Fluid flows into and out of the piston chambers 1018 via the hollow centre of the piston housing 1002 under the control of a series of check valves (not shown).

In many systems the choice of pump is constrained by available space and/or power. Accordingly, it is generally desirable to increase the efficiency of a pump, in particular over a range of speeds or for a range of flow rates. Additionally or alternatively, it is generally desirable to reduce the size of pump required for a given flow rate.

WO2017/098250 (Domin Fluid Power Limited) discloses a radial pump or motor comprising a plurality of reciprocal elements, for example pistons balls or rollers, arranged in at least two layers. The reciprocal elements of each of the at least two layers are arranged to follow a different cam surface. The pump may comprise at least two valves, each valve being arranged to control the flow of fluid to or from a different one of said layers (or a different group of said layers) such that each of the at least two layers may be switched between a pumping and a non-pumping state by operating the relevant valve. In this way the displacement of the pump of WO 2017/098250 may be varied, allowing for improved efficiency over a wider range of speeds than fixed displacement pumps. It would be advantageous to provide a radial piston pump that is more compact for a given flow rate and/or less mechanically complex than the pump of WO2017/098250 while still providing the variable displacement of WO2017/098250.

The present disclosure seeks to mitigate the above-mentioned problems. Alternatively or additionally, the present disclosure seeks to provide an improved radial piston pump and/or improved systems incorporating a radial piston pump.

SUMMARY

In a first aspect of the disclosure there is provided a radial piston pump comprising a rotor having a plurality of piston chambers; a first set of pistons and a second set of pistons received in said piston chambers. The pump may further comprise a first cam surface and a second cam surface. The rotor may be mounted for rotation relative to the first cam surface and the second cam surface, the first cam surface being arranged to control the radial movement of the pistons of the first set, and the second cam surface being arranged to control the radial movement of the pistons of the second set. The radial piston pump may comprise a valve configured to control the flow of fluid to both the first set of pistons and the second set of pistons. The radial piston pump may comprise a valve configured to control the flow of fluid from both the first set of pistons and the second set of pistons. The valve may be configured to switch the radial piston pump from a first configuration to a second configuration by altering the flow of fluid to or from the second set of pistons independently of the first set of pistons.

Thus, it may be that in radial piston pumps in accordance with the present disclosure the same valve switches the flow to or from both sets of pistons independently (e.g. switches the flow to one set of pistons without substantially altering the flow to or from the other set of pistons). Use of a single valve to control the flow associated with the various different layers may provide a variable displacement pump with a reduced part count (and therefore reduced mechanical complexity) in comparison with other variable displacement pumps and/or allow for a more compact variable displacement pump for a given flow rate.

The valve may be configured to switch the radial piston pump from the first configuration to a third configuration and/or fourth configuration by altering the flow of fluid to or from the first set of pistons independently of the second set of pistons. Thus, it may be that the same valve allows three and/or four different modes of operation of the pump. Thus, pumps in accordance with the present disclosure may provide multiple modes of operation while using the same valve for the various different layers.

As used herein the terms low pressure and high pressure fluid refer to flow prior to and after pressurisation by the pistons respectively.

In the context of a valve configured to alter the flow of fluid to from one set of pistons independently of another set of pistons, the term independently may be understood as requiring that the valve can substantially alter the flow of fluid to one set of pistons (for example switch it on, switch it off, or route it to a different destination) without significantly impacting on the flow of fluid to the other set of pistons.

Altering the flow of fluid to or from a set of pistons may comprise opening or closing a flow path to or from a set of pistons. Altering the flow of fluid may comprise opening a flow path so that fluid can flow to a set of pistons that did not receive a flow of fluid in the other configuration. Altering the flow of fluid may comprise closing a flow path so that fluid can no longer flow to a set of pistons that received a flow of fluid in the other configuration. Altering the flow of fluid may comprise closing a flow path and opening a different flow path so that fluid takes a different route to or from a set of pistons, for example so that fluid from a different source is delivered to the set of pistons or fluid from the set of pistons is sent to a different destination.

It may be that in the first configuration the valve provides a flow path for fluid to the first set of pistons but not the second set of pistons. It may be that in the second configuration the valve provides flow paths for fluid to both the first and second set of pistons. In the case that the valve is configured to control the flow of fluid to the first and second set of pistons, the valve may switch the pump between a first configuration in which fluid flows to the first set of pistons but not the second set of pistons and a second configuration in which fluid flows to the second set of pistons. Thus, a variable displacement pump may be provided in which fluid does not flow to the second set of pistons when their output is not required. Variable displacement pumps in which fluid does not flow to those sets of pistons that are not required may achieve improved efficiency as the motor of such pumps does not need to overcome the losses associated with pumping fluid in the second set of pistons.

The valve may be configured to switch the pump between the first configuration, the second configuration and a third configuration in which fluid flows to the second set of pistons but not the first set of pistons.

It may be that in the first configuration the valve provides flow paths for fluid from both the first and second set of pistons. It may be that in the second configuration the flow path for fluid from the second set of pistons is different from the flow path for fluid from the second set of pistons in the first configuration. Thus, altering the flow of fluid from a set of pistons may comprise changing the flow path followed by fluid after leaving the pistons of that set.

In the case that the valve is configured to control the flow of fluid from the first and second set of pistons, the valve may switch the pump between a first configuration in which fluid from the second set of pistons flows along a first flow path and a second configuration in which fluid from the second set of pistons flows along a second, different flow path. It may be that fluid from the first set of pistons flows along the same flow path (for example a third flow path) in both the first and second configurations.

Providing a valve configured to control the flow of fluid from the pistons (rather than to the pistons) may facilitate the provision of an increased number of modes of operation of the pump and/or allow for the pump to provide high pressure fluid for auxiliary functions. For example, high pressure fluid not required by the hydraulic system to which the pump is connected may be diverted to a cooling circuit to cool the pump and/or other elements of the hydraulic system.

It may be that the valve is configured to switch the pump between the first and/or second configuration and a third configuration in which fluid from the first set of pistons flows along a different flow path (for example a fourth flow path) to that of first and second configuration. It may be that fluid from the second set of pistons flows along the second flow path in the third configuration.

It may be that the valve is configured to switch the pump between the first, second and/or third configuration and a fourth configuration in which fluid from the first set of pistons flows along a different flow path (for example a fourth flow path) to that of first and second configuration. It may be that fluid from the second set of pistons flows along the first flow path in the fourth configuration.

It may be that the valve is configured to switch the pump between the first, second, third and/or fourth configuration and a fifth configuration in which fluid from the first set of pistons flows along both the third and fourth flow paths and/or fluid from the second set of pistons flows along both the first and second flow paths.

The second and third flow paths may be exit flow paths via which fluid exits the pump. Each exit flow path may be connected to a pump outlet suitable for connection to a hydraulic system such that, in use, the pump supplied high-pressure fluid to the hydraulic system.

The first and fourth flow paths may be bypass flow paths via which fluid is returned to (i) a point located upstream of the first and/or second set of pistons and/or (ii) a reservoir of low pressure fluid (or a pump outlet suitable for connection to such a reservoir).

It will be appreciated that a valve configured to control the flow of fluid to the first and second set of pistons is located upstream of the first and second set of pistons. Similarly, a valve configured to control the flow of fluid from the first and second set of pistons is located downstream of the first and second set of pistons.

It may be that the valve is a spool valve. The spool valve may comprise a spool mounted for movement with respect to a surface comprising a plurality of internal ports. The pump may be configured so that the relative movement of these spool and the internal ports controls the flow of fluid to or from the first and second set of pistons.

The spool may be mounted for movement between a first position and a second position. It may be that movement of the spool from the first position to the second position switches the pump from the first configuration to the second configuration. The spool may be mounted for movement between the first and/or second position and a third position. It may be that movement of the spool from the first and/or second position to the third position switches the pump from the first and/or second configuration to the third configuration. The spool may be mounted for movement between the first, second and/or third positions and a fourth and/or fifth position. It may be that movement of the spool from the first, second and/or third position to the fourth and/or fifth position switches the pump from the first, second and/or third position to the fourth and/or fifth configurations.

The spool may be mounted for rotational movement between the first, second, third (if present), fourth (if present) and fifth (if present) positions. A rotary spool valve may allow for a more compact pump for a given flow rate and/or facilitate a more compact pump through better packing of flow galleries within the pump.

The spool may be mounted for axial movement between the first, second, third (if present), fourth (if present) and fifth (if present) positions. In some circumstances, for example where complex flow connections are not required, such a linear spool valve may be advantageous.

The spool may include a surface having one or more grooves formed therein. Fluid may flow through the servo valve to or from the pistons via the one or more grooves. It may be that fluid flows via a first groove to or from the first set of pistons. It may be that fluid flows via a second groove to or from the second set of pistons. It will be appreciated that when a groove is aligned with two ports fluid may flow between the two ports via the groove. Thus, the spool valve may alter the flow of fluid to or from the pistons by bringing the one or more grooves into and/or out of alignment with the ports. It will be appreciated that by arranging the geometry of the grooves and ports, independent control of different sets of pistons may be achieved.

The spool may be located within a cavity defined at least in part by the surface comprising the plurality of internal ports. The spool and cavity may be located within the cavity such that the gap between the spool and the surface defining the cavity is small enough to prevent any significant flow of fluid between the surface of the spool and the surface of the cavity other than via the one or more grooves.

It may be that when the spool is in the first position, the first groove is aligned with two ports and that when the spool is in the second position, the first groove is aligned with the same two ports. It may be that when the spool is in the second position, the second groove is aligned with two ports and that when the spool is in the first position, the second groove is not aligned with the same two ports. It may be that when the spool is in the third position the first groove is aligned with a different pair of ports from those with which it is aligned in when the spool is in the first and second positions. Similarly, the first and/or second groves may be aligned with different combinations of ports in the fourth and/or fifth positions.

An inlet port may be defined as port via which fluid flows into a groove. An outlet port may be defined as a port via which fluid flows out of a groove.

The plurality of internal ports may include piston ports, each piston port being associated with (i.e. in fluid communication with) either the (chambers of the) first set of pistons or the (chambers of the) second set of pistons. Piston ports associated with the pistons of the first and second set may be referred to as first piston ports and second piston ports respectively. In the case that the valve controls the flow of fluid to the first and second set of pistons, the piston ports will be outlet ports. In the case that the valve controls the flow of fluid from the first and second set of pistons, the piston ports will be inlet ports.

The plurality of internal ports may include supply ports. In use, each supply port may be connected to a supply of (low pressure) fluid, for example a reservoir of low pressure fluid. Thus, supply ports may be inlet ports.

The plurality of internal ports may include bypass ports. Each bypass port may be connected to a point upstream of the first and/or second set of pistons and/or to a reservoir of low pressure fluid. Provision of such a bypass port may allow for a supply of high pressure fluid to be recirculated within the pump, thereby allowing for cooling of the pump and/or rotation of the motor shaft without substantial fluid resistance.

The plurality of internal ports may include exit ports. Each exit port may be connected to a pump outlet. Thus, exit ports may be outlet ports.

In the case that the valve controls the flow of fluid to the first and second set of pistons, it may be that in the first position and the second position the first groove is aligned with a supply port and a first piston port. It may be that in the second position the second groove is aligned with a supply port and a second piston port. It may be that in the first position the second groove is not aligned with one or both of a supply port and a second piston port. It may be that in the third position the second groove is aligned with a supply port and a second piston port. It may be that in the third position the first groove is not aligned with one or both of a supply port and a first piston port.

In the case that the valve controls the flow of fluid from the first and second set of pistons, each piston port may be connected to the associated set of pistons so that, in use, fluid flows from the set of pistons to the spool via the piston port. It may be that in the first position and the second position the first groove is aligned with a first piston port and an exit port. It may be that in the first position the second groove is aligned with a second piston port and one of a bypass port and an exit port. It may be that in the second position the second groove is aligned with a second piston port and the other of a bypass port and an exit port. It may be that in the third position the first groove is aligned with a first piston port and a bypass port. It may be that in the third position the second groove is aligned with a second piston port and one of a bypass port and an exit port. It may be that in a fourth position the second groove is aligned with a second piston port and the other of a bypass port and an exit port. Thus, the valve may be configured to switch the pump to a fourth configuration. It may be that in a fifth position the first groove is aligned with a first piston port, a bypass port and an exit port. It may be that in the fifth position the second groove is aligned with a second piston port, a bypass port and an exit port.

At least a portion of the rotor may overlap a portion of the valve, for example the spool. For example, the valve, for example the spool, and the rotor may be concentric. It may be that a least part of the valve, for example, the spool is located inside a portion of the rotor. It may be that the rotor has a longitudinal axis (an axis of rotation) about which the rotor rotates. It may be that the spool has a longitudinal axis along which or about which the spool moves. It may be that the longitudinal axes of the rotor and the spool are parallel. It may be that the spool and the rotor are coaxial (i.e. the spool and the rotor have a common longitudinal axis).

Providing the valve that controls the flow to the pistons within the rotor may allow for a more compact pump for a given flow rate. Additionally or alternatively, providing the valve within the rotor may reduce the length and/or complexity of the flow paths within the pump thereby reducing the associated pressure losses and increasing efficiency.

The pump may comprise a pintle. Further features of said pintle are described below in relation to the X aspect. The rotor may be mounted for rotation on the pintle. A portion of the valve, for example the spool, and the pintle may be concentric. It may be that at least part of the valve, for example the spool, is located inside a portion of the pintle. It may be that the pintle has a longitudinal axis (an axis of rotation) about which the rotor rotates. It may be that the longitudinal axes of the rotor, pintle and/or spool are parallel. It may be that the spool, rotor and/or pintle are coaxial (i.e. the spool and the rotor have a common longitudinal axis).

It may be that a surface, for example an internal surface, of the pintle comprises the plurality of internal ports. It may be that the surface of the pintle defines, at least in part, a cavity within the pintle, at least a portion of the valve, for example the spool, being received within said cavity. Thus, the spool may be located within a cavity formed within the pintle upon which the rotor rotates. The spool may be mounted for movement relative to the pintle.

Locating the valve within the pintle on which the rotor is mounted may provide a more compact pump for a given flow rate. Additionally or alternatively, providing the valve within the pintle allows the pintle to form the manifold for the valve thereby reducing the number of elements in the pump and/or allowing for a yet more compact pump for a given flow rate.

The radial piston pump may comprise a control motor configured to move the valve, for example the spool, between the first, second, third (if present), fourth (if present) and/or fifth (if present) positions.

The pintle may comprise one or more flow galleries via which fluid can flow. Each flow gallery may be connected to one or more internal ports of the spool valve. For example the pintle may comprise piston flow galleries, each piston flow gallery connecting the pistons (or piston chambers) of the first or second set of pistons to the piston ports. The pintle may comprise exit flow galleries connecting the exit ports to one or more outlets for connecting the pump to a hydraulic system. The pintle may comprise bypass flow galleries connecting the bypass ports to a point upstream of the first and/or second set of pistons or to a reservoir of low pressure fluid.

The first and/or second cam surface may be shaped such that each piston of the first and/or second set respectively completes two, four, six or more reciprocal movements (each reciprocal movements comprising a movement in a first direction and a movement in a second, opposite, direction) for each complete rotation of the rotor. The first and/or second cam surface may shaped such that each piston completes only two, four or six reciprocal movements for each complete rotation of the rotor.

It may be that the radial distance between the longitudinal axis of the rotor and the cam surface varies circumferentially (e.g. around the circumference of the rotor and/or cam surface). Each of the first and/or second cam surface may comprise one or more regions of decreasing radius (e.g. regions in which the radius is decreasing, corresponding to movement of the piston in a first direction) and one or more regions of increasing radius (e.g. regions in which the radius is decreasing, corresponding to movement of the piston in a second, opposite direction). Each region of decreasing radius may be located between two regions of increasing radius, and vice versa. Each region of decreasing radius may be located opposite another region of decreasing radius. Each region of increasing radius may be located opposite another region of increasing radius.

The profile of the cam surface may be defined as the variation of the radius of the cam surface around the circumference of the cam surface and/or rotor. The radius of the cam surface may be defined as the distance between the cam surface and the point about which the rotor rotates relative to the cam surface.

The profile of the cam surface may comprise one or more cycles, each cycle comprising a region of increasing radius and a region of decreasing radius. Thus, each cycle of the cam surface may correspond to a cycle (a complete forward and backwards movement) of the piston. The profile of the cam surface may comprise two, four, six or more cycles. The profile of the cam surface may comprise only two, four or six cycles.

Each cam surface may comprise a surface facing towards the longitudinal axis (the axis of rotation) of the rotor. Each cam surface may extend circumferentially around the rotor, for example around the whole of the circumference of the rotor. Each cam surface may extend for 360 degrees around the rotor.

The radial piston pump may comprise a plurality of cam followers arranged to travel along the first or second cam surface as the rotor rotates relative to the first and second cam surface, each piston being connected to a cam follower such that radial displacement of the cam follower results in radial displacement of the piston. The radial piston pump may comprise a first set of cam followers arranged to travel along (follow) the first cam surface and a second set of cam followers arranged to travel along (follow) the second cam surface. The pistons of the first set may be connected to cam followers of the first set. The pistons of the second set may be connected to cam followers of the second set.

It may be that the piston chambers and/or pistons of the first set are spaced apart from the piston chambers and/or pistons of the second set along the longitudinal axis (the axis of rotation) of the rotor. It may be that the first cam surface is spaced apart from the second cam surface along the longitudinal axis of the rotor. It may be that the position of each cam surface is fixed relative to the housing of the pump. It may be that the pistons of the first set are located at substantially the same position along the longitudinal axis of the rotor. It may be that the pistons of the second set are located at substantially the same position along the longitudinal axis of the rotor.

The radial piston pump may be an inside impinged piston pump. The radial piston pump, for example the rotor and/or pintle may comprise, consist essential of, or consist of metal, for example steel, aluminium, bronze, titanium or other appropriate materials.

The pump (or the system of which it forms a part) may comprise a control system configured to control the operation of the pump, for example the speed of the motor and/or the valve. The control system may be configured to control the control motor (to move the valve) and/or the motor that rotates the rotor in response to a user input and/or a single received from a feedback system. The pump may comprise a feedback system, for example an electrical feedback system, configured to provide information on the state of the valve, for example the location of the spool and/or the speed of the rotor. The feedback system may comprise on or more sensors, for example electrical transducers, mounted on the spool and/or the rotor.

The pump may comprise further sets of pistons. The valve may be configured to control the flow to or from each set of pistons. The valve may be configured to control the flow of fluid of each further set of pistons independently from the first and/or second set of pistons. Alternatively, the pump may comprise a first group of pistons comprising the pistons of the first set and the pistons of one or more further sets and a second group of pistons comprising the pistons of the second set and the pistons of one or more further sets. The valve may be configured to switch the radial piston pump from a first configuration to a second configuration by altering the flow of fluid to or from the second group of pistons independently of the first groups of pistons.

In a second aspect of the disclosure, there is provided a radial piston pump comprising one or more of a rotor having a plurality of piston chambers; a first set of pistons and a second set of pistons received in said piston chambers; a first cam surface and a second cam surface. The rotor may be mounted for rotation relative to the first cam surface and the second cam surface. It may be that the first cam surface is arranged to control the radial movement of the pistons of the first set, and the second cam surface being arranged to control the radial movement of the pistons of the second set. The pump may comprise a valve configured to control the flow of fluid to or from the first and second set of pistons, said valve being concentric with the rotor.

Use of the same, concentrically mounted, valve to control the flow to or from both sets of pistons may provide a more compact pump for a given flow rate and/or provide a mechanically simpler pump.

The pump of the second aspect may have any of the features described above in respect of the first aspect. For example, the valve may be a spool valve as described above and/or the rotor may be mounted on a pintle as described above.

In a third aspect of the disclosure, there is provided a radial piston pump comprising one or more of: a motor comprising a plurality of magnets, a plurality of coils and a stator; a rotor, mounted for rotation with respect to the stator and having a plurality of piston chambers and a plurality of pistons received in said piston chambers. It may be that either the plurality of magnets or the plurality of coils is mounted on the stator and the other of the plurality of magnets and the plurality of coils is mounted on the rotor.

Thus, radial piston pumps in accordance with the present disclosure may comprise a common rotor as between the pump and the motor. Use of such a common rotor may allow for a more compact pump for a given flow rate and/or reduce the mechanical complexity of the pump with respect to similar prior art pumps.

It will be appreciated that the plurality of magnets or the plurality of coils are mounted on the rotor for rotation therewith, such that when a current is provided to the coils in the presence of the magnetic field of the magnets an electromotive force is generated thereby rotating the rotor. Electric motors per se are well known and will not be described further here.

The rotor may be mounted on the pintle for rotation with respect to the stator. The pump may be configured such that a hydrostatic bearing is formed between the pintle and the rotor, said hydrostatic bearing comprising (high pressure) fluid from said piston chambers.

By reducing friction between the rotor and pintle a hydrostatic bearing may provide a more efficient pump and/or increase the lifespan of the pump by reducing wear on the pintle and/or rotor. Use of hydrostatic bearings may be particularly advantageous in pumps having a first and second set of pistons because it allows for a more compact packaging, lower noise and/or faster speed.

Each of the pintle and rotor may comprise one or more bearing surfaces via which loads from the rotor are transmitted to the pintle. The bearing surface of the pintle may be an outer surface of the pintle, for example a surface facing away from the longitudinal axis of the pintle and/or rotor. The bearing surface of the rotor may be an inner surface of the rotor, for example a surface facing towards the longitudinal axis of the pintle and/or rotor. The hydrostatic bearing may comprise a layer of fluid located between a bearing surface of the pintle and a bearing surface of the rotor. The layer of fluid may comprise fluid that has been pressurised by passage through the piston chambers of the pump. Thus, the layer of fluid may be high pressure fluid.

The bearing surface(s) of the pintle and/or the bearing surface(s) may comprise one or more orifices configured to provide fluid to the hydrostatic bearing. Said one or more orifices may be in fluid communication with one or more of said piston chambers. A bearing surface may comprise a first orifice or set of orifices in fluid communication with the piston chambers of the first set of pistons. A bearing surface may comprise a second orifice or set of orifices in fluid communication with the piston chambers of the second set of pistons. The pintle and or the rotor may comprise one or more flow galleries forming part of a flow path between the one or more orifices and the piston chambers.

The radial piston pump may comprises a housing. The rotor and/or the stator may be located (at least partially) within the housing.

The housing may comprise one or more dividing walls configured to provide a first compartment in which the rotor is located and a second compartment in which the stator is located. The dividing wall(s) may configured such that fluid from the rotor does not come into contact with the stator. Thus, the first compartment may be a water-tight compartment.

Separating the 'wet' components (e.g. the rotor and pistons) from the electronics (for example the coils using an interior wall may provide a more reliable and/or robust pump.

The radial piston pump may comprise one or more cooling flow galleries configured to provide a flow path for fluid around one or more components of the pump, for example around the motor and/or rotor of the pump, such that fluid in said cooling flow galleries can absorb excess heat from said components. The cooling flow gallery(ies) may be in fluid communication with the first compartment, for example to receive fluid leaking from the piston chambers to the exterior of the rotor and/or into the first compartment. Thus, fluid leaking from the piston chambers may be used to cool the pump.

Using high pressure fluid leaking from the piston chambers to cool the pump may allow cooling of the pump to take place with significant impact on the efficiency of the pump as there is no need to pressurise fluid for the express purpose of cooling the pump and instead hydraulic power that may otherwise go to waste is harnessed for a useful purpose.

Alternatively, the cooling flow galleries may form part of a bypass flow path, for example the cooling flow galleries may be bypass flow galleries and/or connected to a bypass port. Thus, high-pressure fluid not output from the pump may be recirculated to cool the pump thereby allowing cooling of the pump with a minimal impact on efficiency.

In a fourth aspect of the disclosure, there is provided a radial piston pump comprising a rotor mounted for rotation on a pintle, the rotor comprising a plurality of piston chambers, a piston being mounted in each of said chambers for reciprocal movement. The pump comprising one or more of at least one supply flow path which, in use, connects one or more of the piston chambers to a supply of low-pressure fluid; at least one exit flow path via which, in use, high-pressure fluid from one or more of the piston chambers leaves the pump; and at least one auxiliary flow path which connects another component of the pump to one or more of the piston chambers. It may be that the pintle comprises a plurality of flow galleries, said plurality comprising one or more of at least one supply flow gallery forming part of the supply flow path, at least one exit flow gallery forming part of the exit flow path and at least one auxiliary flow gallery forming part of the auxiliary flow path.

Thus, radial piston pumps in accordance with the present disclosure may use the pintle as a fluid manifold providing fluid to or from the pistons and to or from at least one other component of the pump. Having such a multifunction pintle may allow for a more compact pump for a given flow rate and/or reduce the number of components in the pump. Additionally or alternatively, using the pintle as a fluid manifold for other components of the pump may reduce the distance travelled by fluid within the pump and the pressure losses associated therewith.

The pump may be configured such that, in use, high-pressure fluid from one or more of the piston chambers is provide to said another component via the auxiliary flow path.

The pump may comprise a return flow path connected to an outlet of said another component of the pump. The pump may be configured such that, in use, (low-pressure) fluid leaves said another component and/or the pump via the return flow path. The pintle may comprise at least one return flow gallery forming part of the return flow path.

The plurality of flow galleries, for example the at least one supply flow gallery, at least one exit flow gallery, at least one auxiliary flow gallery and/or at least one return flow gallery (if present), may be present at the same axial position on the pintle (i.e. at the same location on the longitudinal axis of the pintle). The at least one at least one exit flow gallery, at least one auxiliary flow gallery and/or at least one return flow gallery (if present) may be spaced apart circumferentially around the pintle.

The plurality of flow galleries may be integrally formed with the pintle. That is to say, the plurality of flow galleries may be formed within the pintle as a single piece, for example using an additive manufacturing process.

The auxiliary flow path may connect the pistons and a control valve (i.e. said another component may be a control valve). The control valve may comprise a pressure inlet, a return outlet and a first and/or second service outlet. For example the control valve may be a three-way valve comprising a pressure inlet, a return outlet and a first service outlet. Alternatively, the control valve may be a four-way valve comprising a pressure inlet, a return outlet, a first service outlet and a second service outlet. The auxiliary flow path may connect the pressure inlet to the one or more piston chambers. For example, in use, high-pressure fluid from the piston chambers may be provided to the pressure inlet of the control valve via the auxiliary flow path. The return flow path may connect to the return outlet of the control valve, such that in use, fluid from the control valve flows to a (low-pressure) reservoir and/or outlet of the pump suitable for connection to such a reservoir via the return flow path. The pump may comprise one or more first and/or second service flow paths via which, in use, a first and second service flow (respectively) from the control valve may exit the pump. The pump may comprise one or more service ports suitable for connection to an actuator or other hydraulic component, for example an actuator for providing or controlling linear motion or force, or a rotary actuator acting as a pump or motor to be control as a component of a transmission. The pump may comprise one or more first service ports and/or second service ports via which a first service flow path or second service flow path is connected to an actuator or other hydraulic components. Thus, in use, first and/or second service flows from the control valve may be provided to a hydraulic component connected to the pump via the first and/or second service ports.

The plurality of flow galleries may further comprise at least one first and/or second service flow gallery forming part of the first or second service flow path respectively.

The pump may comprise a first set of flow paths including an auxiliary flow path, a return flow path and first and/or second service flow paths and a second set of flow paths including an auxiliary flow path, a return flow path and first and/or second service flow paths, the flow paths of the first set being connected to a first component and the flow paths of the second set being connected to a second, different component. The pintle may comprise a first set of flow galleries, each flow gallery of the first set forming part of one of the flow paths of the first set and a second set of flow galleries, each flow gallery of the second set forming part of one of the flow paths of the second set. The pump may comprise further components, and further sets of flow paths associated with each component. The pintle may comprise further sets of flow galleries, each flow gallery of a further set forming part of one of the flow paths of a further set.

The control valve may be a servo valve. The servo valve may comprise a spool mounted for movement with respect to a sleeve comprising a plurality of internal ports. The servo valve may be configured such that movement of the spool relative to the sleeve controls the flow through the valve, for example by varying the flow of fluid through a groove formed in the surface of the spool. The function of the servo valve may be as discussed in connection with the spool valve above. In the case of a three-way servo valve the valve is configured such that movement of the spool determines whether and which of the auxiliary flow path and the return flow path are in fluid communication with the first service path. In the case of a four-way servo valve the valve is configured such that movement of the spool determines whether and which of the auxiliary flow path and the return flow path are in fluid communication with the first service flow path and whether and which of the auxiliary flow path and the return flow path are in fluid communication with the second service flow path. The control valve may comprise a control valve motor configured to move the spool.

It will be appreciated that the pump may comprise a spool valve (described above) configured to control flow to or from the piston chambers and a control valve configured to receive high-pressure fluid from the piston chambers. The pintle may be a pintle as described above in connection with the first aspect. For example, the pintle may be configured to receive at least a portion of the valve configured to control the flow of fluid to or from both the first set of pistons and the second set of pistons.

The pintle may further comprise one or more sensors and/or sensor targets. The pump may comprise a feedback system configured to detect the rotary position of the rotor using said sensors and/or to calculate velocity and/or acceleration of the pump on dependence on the rotary position so detected.

The pintle may comprise one or more recesses extending along at least a portion, for example the whole of, the length of the pintle. The or each recess may be configured to receive (or may contain at least a portion of) an elongate member, for example the rod of a piston. The pintle may comprise an anti-rotation device configured to prevent rotation of the elongate member relative to the pintle. The anti-rotation device may comprise an interlock feature (for example a protrusion or indentation) configured to be received in a corresponding interlock feature (for example the other of a protrusion or indention) on the elongate member such that in use, when the two interlock features are engaged rotation of the elongate member relative to the protrusion is prevented.

In a fifth aspect of the disclosure there is provided an hydraulic power pack comprising a radial piston pump in accordance with any other aspect, for example any of the first to fourth aspects.

The hydraulic power pack may be configured to provide a supply of high pressure fluid to a hydraulic system. The hydraulic power pack may comprise a reservoir configured to store a supply of low-pressure fluid. The fluid reservoir may be connected to the inlet of the pump and/or a supply flow path of the pump such that low-pressure fluid from the fluid reservoir is supplied to the pump. The hydraulic power pack may comprise an accumulator configured to store a supply of high-pressure fluid for use in the hydraulic system. The accumulator may be connected to an outlet of the pump and/or an exit flow path of the pump such that high-pressure fluid from the pump is supplied to the accumulator.

The hydraulic power pack may comprise a fluid reservoir piston which defines, at least in part, the fluid reservoir. The hydraulic power pack may comprise an accumulator piston which defines, at least in part, the accumulator. The fluid reservoir piston and/or the accumulator piston may be mounted on the pintle for movement (for example axial movement) relative to the pintle and/or each other. At least a portion of the fluid reservoir piston and/or the accumulator piston may be received in a piston recess formed within and extending along a portion, for example the majority of the length, of the pintle. The piston recess may comprise a through hole in the pintle upon which the rotor in mounted. The fluid reservoir piston and/or the accumulator piston may be received in the same piston recess.

The fluid reservoir piston, the accumulator piston may be coaxial, the pintle and/or the rotor may be coaxial. The fluid reservoir piston, the accumulator piston the pintle and/or the rotor may be concentric. A portion of one of the fluid reservoir piston and the accumulator piston may be received within a piston recess formed in the other of the fluid reservoir piston and the accumulator piston.

Each of the fluid reservoir piston and/or the accumulator piston may comprise a piston head and a piston stem extending therefrom. The piston may define, at last in part the fluid reservoir or the accumulator. Each of the fluid reservoir piston and/or the accumulator piston may comprise one or more flow galleries. The fluid reservoir piston may comprise one or more flow galleries connecting the fluid reservoir to the inlet of the pump and/or the supply flow path of the pump. The accumulator may comprise one or more flow galleries connecting the outlet and/or the exit flow path of the pump to the accumulator.

The hydraulic power pack may be configured such that force generated by the high-pressure fluid in the accumulator is transmitted to the low-pressure fluid in the reservoir via the fluid reservoir piston. For example, a portion of the fluid reservoir piston, for example the distal end of the piston stem, may define, at least in part, the accumulator. Thus, said portion of the fluid reservoir piston may be exposed to the high-pressure fluid in the accumulator.

The hydraulic power pack may comprise a power pack housing. The radial piston pump may be located within the power pack housing. The power pack housing may comprise one or more internal walls dividing the power pack into a first compartment in which the rotor is located and a second component in which the stator of the motor is located. The internal wall(s) may be configured to provide a water-tight barrier between the first and second compartments such that fluid from the first compartment cannot come into contact with the stator.

In a six aspect of the disclosure there is provided a brake system for a vehicle, for example an automotive, the brake system comprising a radial piston pump and/or hydraulic power pack in accordance with any other aspect.

The brake system may comprise a brake pad and an actuator configured to move the brake pad from a first position to a second position in order to effect braking of a wheel of the vehicle. The brake system may comprise a fluid reservoir for storing low-pressure fluid. The brake system may be configured such that in use, low-pressure fluid from the reservoir is supplied to the pump and/or high-pressure fluid from the pump is supplied to the actuator (for example via an accumulator or directly to the actuator). The brake system may comprise a valve configured to control the flow of fluid from both the first set of pistons and the second set of pistons, as described above in connection with the first aspect.

In a seventh aspect of the disclosure, there is provided an active suspension system for a vehicle, for example an automotive, comprising a radial piston pump and/or hydraulic power pack in accordance with any other aspect.

An 'active' suspension system for a vehicle may be defined as one in which energy is provided to an actuator in order to control the relative motion of a vehicle wheel and chassis in response to road conditions. This is in contrast to an active damping system (also known as semi-active or adaptive suspension) where the stiffness of the suspension means (for example the stiffness of the damper which is arranged in parallel to the coil spring in a vehicle suspension) is varied in response to road conditions.

The active suspension system may comprise an actuator configured to exert a force on the wheel and/or chassis of the vehicle. Typically, in an immediate response to a road event (for example cornering, accelerating or braking) a control system will switch on a pump which supplies fluid at pressure to the actuator in order to move the actuator arm and thereby exert a counter force on the chassis and wheel. Generally, power for the pump is supplied by the vehicle's engine. A key challenge for active suspension systems is to provide at short notice the high power output that is required when the vehicle encounters more severe road events, for example speed bumps, and in particular to do so without impacting adversely on the driving experience (for example by drawing excessive amount of power from the engine) and/or without requiring a large valves/pumps. The radial piston pump of the present disclosure may be particularly well suited to this application, because it enables a rapid change in rate of flow to the actuator.

The active suspension system may comprise a damper, for example a spring, configured to exert a force on the wheel and/or the chassis. The damper and actuator may be arranged in parallel. The active suspension system may comprise a fluid reservoir for storing low-pressure fluid. The active suspension system may be configured such that in use, low-pressure fluid from the reservoir is supplied to the pump and/or high-pressure fluid from the pump is supplied to the actuator (for example via an accumulator or directly to the actuator). The active suspension system may comprise a valve configured to control the flow of fluid from both the first set of pistons and the second set of pistons, as described above in connection with the first aspect.

In an eighth aspect of the disclosure there is provided a flight control system for an aircraft, for example a fixed wing aircraft, the flight control system comprising a radial piston pump and/or hydraulic power pack in accordance with any other aspect.

The flight control system may comprise a control surface and an actuator configured to move the control surface (for example a flap, slat or other control surface) from a first position to a second position in order to effect a change in the aerodynamic performance of the control surface. The flight control system may comprise a fluid reservoir for storing low-pressure fluid. The flight control system may be configured such that in use, low-pressure fluid from the reservoir is supplied to the pump and high-pressure fluid from the pump is supplied to the actuator (for example via an accumulator or directly). The flight control system may comprise a valve configured to control the flow of fluid from both the first set of pistons and the second set of pistons, as described above in connection with the first aspect.

The valve (for example of the braking system, active suspension system and/or flight control system) may be configured to switch the pump between a first configuration in which fluid from the second set of pistons flows along a first flow path and a second configuration in which fluid from the second set of pistons flows along a second, different flow path and wherein fluid from the first set of pistons flows along the same flow path (for example a third flow path) in both the first and second configurations. The valve may be configured to switch the pump between the first and/or second configuration and a third configuration in which fluid from the first set of pistons flows along a different flow path (for example a fourth flow path) to that of first and second configuration. It may be that in the third configuration fluid from the second set of pistons flows along the second flow path.

The valve (for example of the braking system, active suspension system and/or flight control system) may be configured to switch the pump between the first, second, and/or third configuration and a fourth configuration in which fluid from the first set of pistons flows along a different flow path (for example a fourth flow path) to that of first and second configuration. It may be that in the fourth configuration fluid from the second set of pistons flows along the first flow path.

The valve may be a spool valve comprising a spool mounted for movement relative to a series of internal ports, the spool valve being configured to switch the pump between the first, second, third and/or fourth configurations by moving the spool (for example rotating the spool or moving the spool axially) relative to the internal ports.

It may that in the first configuration, the first set of pistons is in fluid communication with the actuator (for example the actuator of the braking system, active suspension system and/or flight control system) such that high-pressure fluid from the pistons of the first set can flow to the actuator. It may be that in the first configuration, the second set of pistons is in fluid communication with a point upstream of the pistons of the first and/or second set and/or the fluid reservoir (for example the fluid reservoir of the braking system, active suspension system and/or flight control system) such that high-pressure fluid from the pistons of the second set is recirculated between said point upstream and/or said reservoir and the pistons.

It may that in the second configuration, the first set of pistons is in fluid communication with the actuator such that high-pressure fluid from the pistons of the first set can flow to the actuator. It may be that in the second configuration, the second set of pistons is in fluid communication with the actuator such that high-pressure fluid from the pistons of the second set can flow to the actuator.

It may be that in a third configuration, the first set of pistons is in fluid communication with a point upstream of the pistons of the first and/or second set and/or the fluid reservoir such that high-pressure fluid from the pistons of the second set is recirculated between said point upstream and/or said reservoir and the pistons. It may be that in the third configuration, the second set of pistons is in fluid communication with a point upstream of the pistons of the first and/or second set and/or the fluid reservoir such that high-pressure fluid from the pistons of the second set is recirculated between said point upstream and/or said reservoir and the pistons.

It may that in a fourth configuration the valve is open such that fluid from the first set of pistons and the second set of piston can flow between (i) a point upstream of the pistons of the first and/or second set and/or the fluid reservoir and (ii) the actuator.

In a ninth aspect of the disclosure there is provided a method of braking a vehicle comprising a brake system in accordance with the sixth aspect of the disclosure.

The method may comprise the pump switching to the first configuration in response to a signal indicating a lower level of braking is required. It may be that in the first configuration fluid is supplied to the actuator by the pump at a first lower flow rate.

The method may comprise the pump switching to the second configuration in response to a signal indicating a higher level of braking is required. It may be that in the second configuration fluid is supplied to the actuator by the pump at a second higher flow rate.

The method may comprise the pump switching to the third configuration in the absence of a signal indicating braking is required and/or in response to a signal indicating no braking is required. It may be that in the third configuration no fluid is supplied to the actuator by the pump. It may be that in the third configuration high-pressure fluid from the pump recirculates within the pump and/or braking system to cool the pump, brake pad and/or actuator.

The method may comprise the pump switching to the fourth configuration in response to a signal indicating that a higher level of braking will be requested imminently (for example in less than 1 second). Such a signal may be sent by a control system when it detects one or more conditions indicating a higher level of braking will be requested imminently—for example that a throttle pedal has been sharply disengaged or a sensor on the car has detected an obstacle. It may be that in the third configuration the speed at which the motor drives the pump increases, for example from stationary to half or full speed.

In a tenth aspect of the disclosure there is provided a vehicle, for example an automotive vehicle, comprising a brake system in accordance with the sixth aspect.

In an eleventh aspect of the disclosure there is provided a method of damping the movement of a vehicle comprising an active suspension system in accordance with the seventh aspect of the disclosure.

The method may comprise the pump switching to the first configuration in response to a signal indicating a lower level of damping is required. It may be that in the first configuration fluid is supplied to the actuator by the pump at a first lower flow rate.

The method may comprise the pump switching to the second configuration in response to a signal indicating a higher level of damping is required. It may be that in the second configuration fluid is supplied to the actuator by the pump at a second higher flow rate.

The method may comprise the pump switching to the third configuration in the absence of a signal indicating damping is required and/or a signal indicating the damping is not required. It may be that in the third configuration no fluid is supplied to the actuator by the pump. It may be that in the third configuration high-pressure fluid from the pump recirculates within the pump and/or suspension system to cool the pump and/or actuator.

The method may comprise the pump switching to the fourth configuration in response to a signal indicating that a higher level of damping will be requested imminently (for example in less than 1 second). Such a signal may be sent by a control system when it detects one or more conditions indicating a higher level of damping will be requested imminently—for example a forward-looking sensor on the car has detected an obstacle, for example a speed bump. It may be that in the third configuration the speed at which the motor drives the pump increases, for example from stationary to half or full speed.

In a twelfth aspect of the disclosure there is provided a vehicle, for example an automotive vehicle, comprising an active suspension system in accordance with the seventh aspect.

In a thirteenth aspect of the disclosure there is provided a method of controlling an aircraft comprising a flight control system in accordance with the eighth aspect of the disclosure.

The method may comprise the pump switching to the first configuration in response to a signal indicating power is required by the actuator, for example to move the flight control surface. It may be that in the first configuration fluid is supplied to the actuator by the pump at a first lower flow rate.

The method may comprise the pump switching to the second configuration in response to a signal indicating more power is required by the actuator, for example to move the flight control surface more quickly. It may be that in the second configuration fluid is supplied to the actuator by the pump at a second higher flow rate.

The method may comprise the pump switching to the third configuration in the absence of a signal indicating power is required by the actuator and/or a signal indicating power is not required. It may be that in the third configuration no fluid is supplied to the actuator by the pump. It may be that in the third configuration high-pressure fluid from the pump recirculates within the pump and/or flight control system to cool the pump and/or actuator.

The method may comprise the pump switching to the fourth configuration in response to a signal indicating that a higher level of power will be requested imminently (for example in less than 1 second). Such a signal may be sent by a control system when it detects one or more conditions indicating a higher level of damping will be requested imminently. It may be that in the third configuration the speed at which the motor drives the pump increases, for example from stationary to half or full speed.

In a fourteenth aspect of the disclosure there is provided an aircraft comprising a flight control system in accordance with the eighth aspect.

In a fifteenth aspect of the disclosure there is provided a pintle suitable for use as the pintle of any other aspect.

In a sixteenth aspect of the disclosure, there is provided a method of manufacturing a radial piston pump according to any previous claim, wherein the method comprises producing one or more of the rotor, pintle and/or spool using an additive manufacturing process.

It may be that the method comprises finishing a rotor, pintle and/or spool produced using an additive manufacturing process using a subtractive manufacturing process, for example one or more of grinding, milling, boring and/or polishing.

The method may further comprise a step of assembling one or more of the stator, rotor, pintle and/or spool to produce a radial piston pump according to any previous aspect.

In a seventeenth aspect of the disclosure there is provided a method of operating a radial piston pump (or a hydraulic power pack or brake system comprising such a pump) in accordance with any other aspect.

There may be provided a method of controlling the operation of radial piston pump comprising one or more of: a rotor having a plurality of piston chambers, a first set of pistons and a second set of pistons received in said piston chambers; a first cam surface being arranged to control the radial movement of the pistons of the first set, and a second cam surface being arranged to control the radial movement of the pistons of the second set. It may be that the method comprises a valve controlling the flow of fluid to or from both the first set of pistons and the second set of pistons. The method may comprise the valve altering the flow of fluid to (or from) the second set of pistons without altering the flow of fluid to (or from) the first set of pistons thereby switching the radial piston pump from a first configuration to a second configuration.

The method may further comprise the valve altering the flow of fluid to or from the first set of pistons without altering the flow of fluid to the second set of pistons thereby switching the radial piston pump from a first configuration to a third configuration. The method may further comprise the valve altering the flow of fluid to or from the first set of pistons and the second set of pistons simultaneously thereby switching the radial piston pump from a first configuration to a fourth configuration.

The method may comprise the valve switching the radial piston pump from one configuration to another (for example from the first to the second configuration) in response to a signal (a control signal), for example from a user and/or a control system configured to operate a hydraulic system to which the pump is connected.

The method may comprise the valve switching the pump (i.e. altering the flow) while the rotor is rotating.

The method may comprise increasing the flow rate (for example from a first flow rate to a second, higher flow rate) of high-pressure fluid output from the pump by the valve switching the pump from the first configuration to the second configuration.

The method may comprise cooling the pump by operating the pump in the third configuration and/or increasing cooling of the pump by the valve switching the pump from the first and/or second configuration to the third configuration.

The method may comprise operating the pump in a fourth configuration in which the valve is open such that fluid from both the first set of pistons and the second set of pistons flows to (i) a point upstream of the pistons of the first and/or second set and/or the fluid reservoir and (ii) the outlet of the pump. The method may comprise increasing the speed of the pump, for example of the motor, while the pump is in the further configuration. The method may comprise the valve switching the pump to the first and/or second configuration from the fourth configuration in response to a control signal or when the speed of the pump reaches a predetermined threshold.

There may be provided a method of operating a radial piston pump comprising a rotor mounted for rotation on a pintle. It may be that the rotor comprises a plurality of piston chambers, a piston being mounted in each of said chambers for reciprocal movement. It may be that fluid flows along at least one supply flow path from a supply of low-pressure fluid to one or more of the piston chambers; high-pressure fluid from one or more of the piston chambers leaves the pump via at least one exit flow path; and/or high-pressure fluid from one or more of the piston chambers flows to another component of the pump via at least one auxiliary flow path and is used in the operation of the component. It may be that fluid on the at least one supply flow path, at least one exit flow path and/or at least one auxiliary flow path flows through one or more flow galleries in the pintle.

It will of course be appreciated that features described in relation to one aspect of the present disclosure may be incorporated into other aspects of the present disclosure. For example, the method of the disclosure may incorporate any of the features described with reference to the apparatus of the disclosure and vice versa.

DESCRIPTION OF THE DRAWINGS

Embodiments of the present disclosure will now be described by way of example only with reference to the accompanying schematic drawings of which.

DETAILED DESCRIPTION

Figure 2:
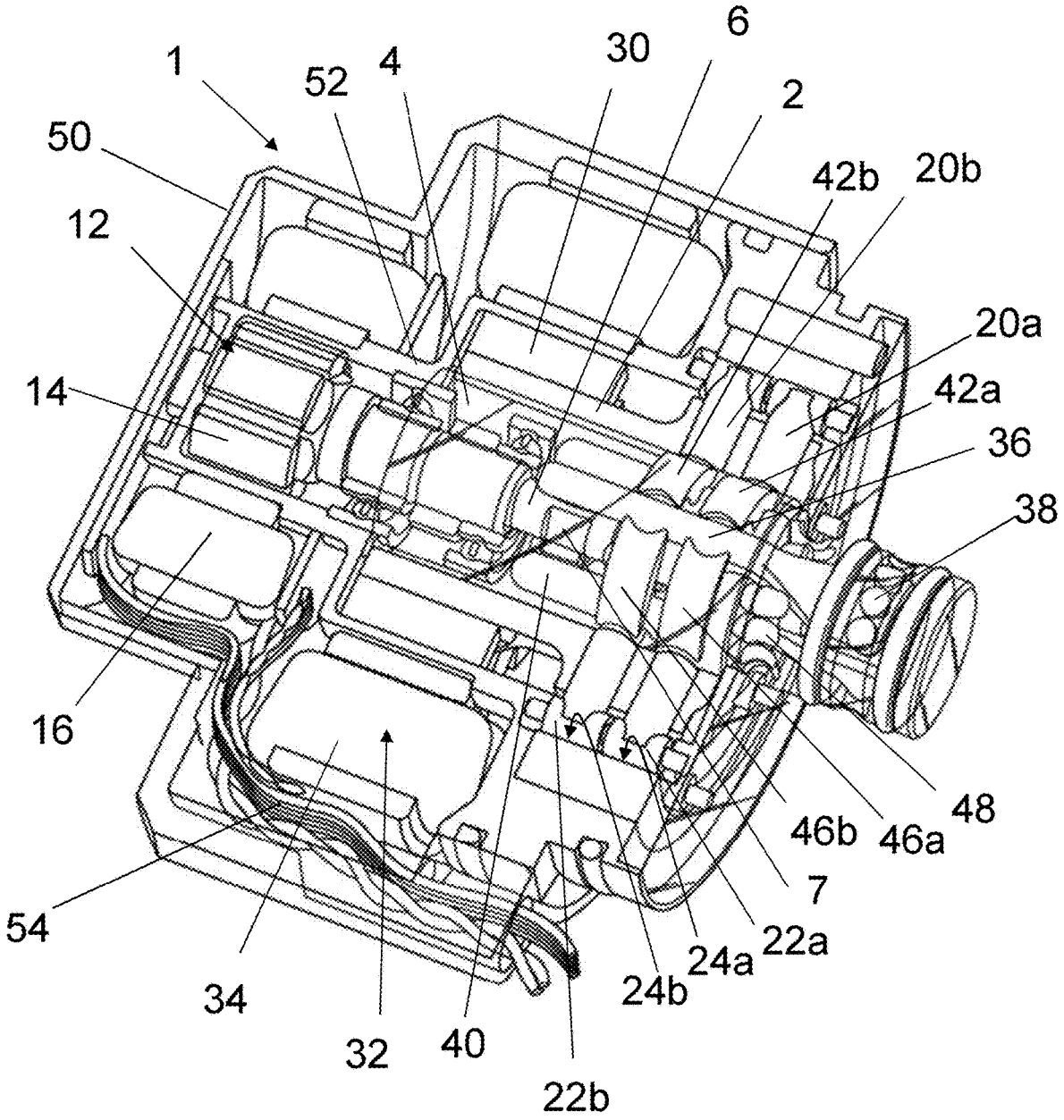
FIG. 2 shows a perspective section view of the radial piston pump and motor assembly according to a first embodiment of the disclosure.
Figure 3A:
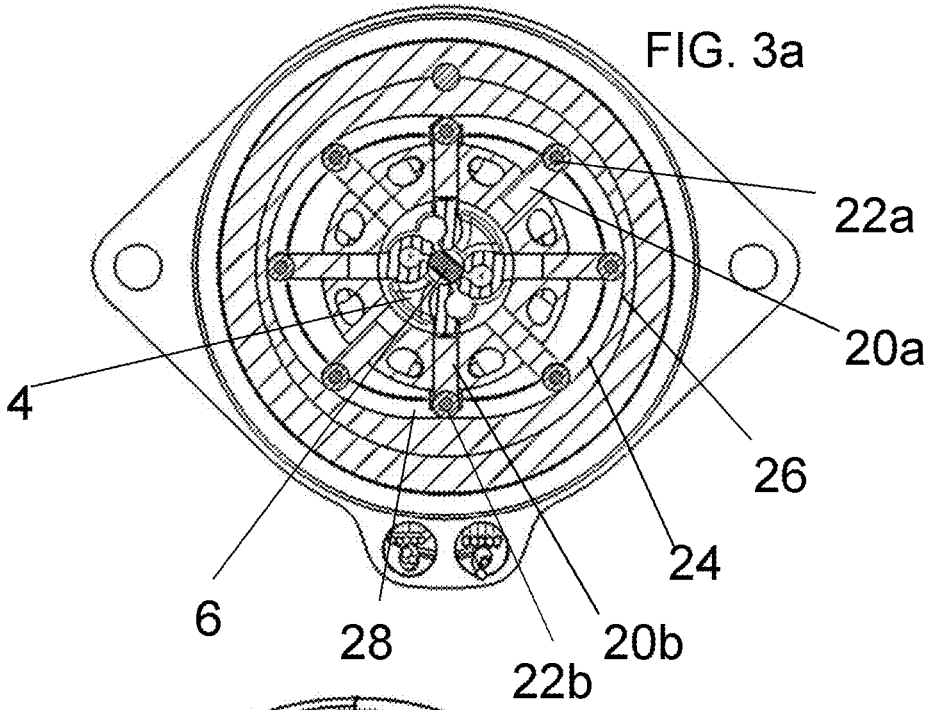
FIGS. 3*a* and 3*b* show perspective section views of the radial piston pump of FIG. 2.
Figure 3B:
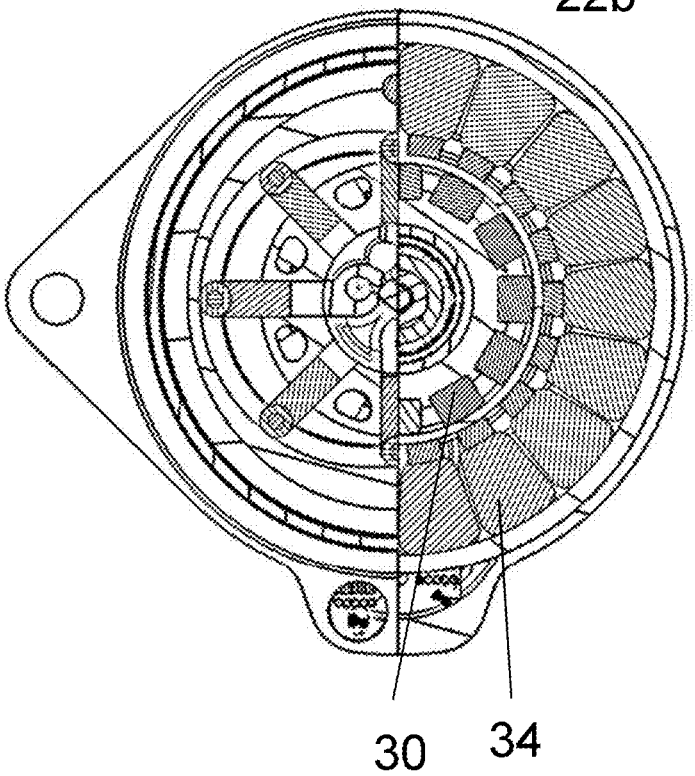
Figure 6A:
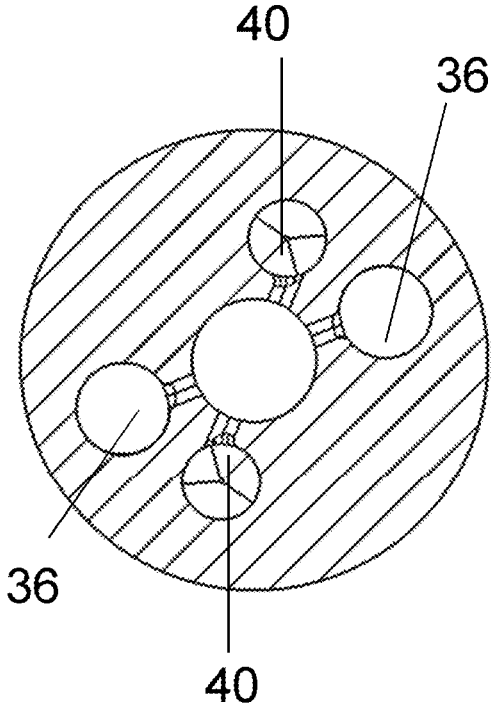
FIGS. 6*a* and 6*b* show cross-section views of the pintle of FIG. 5.
Figure 6B:
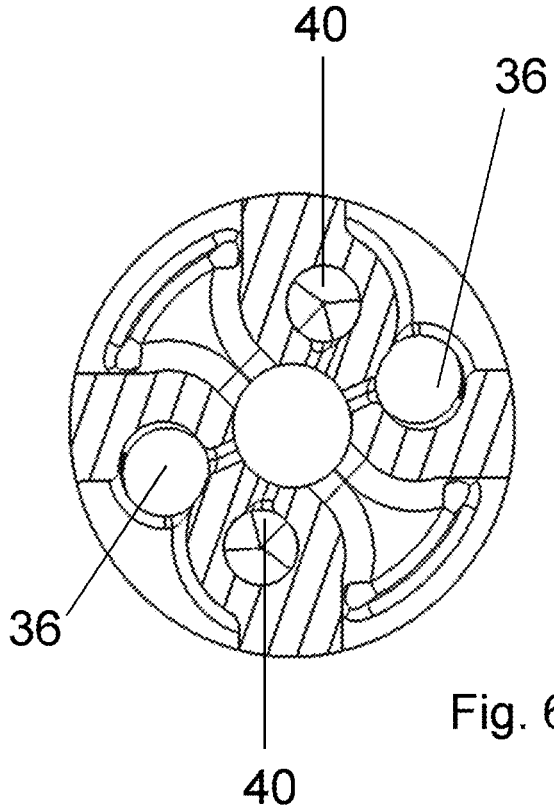
Figure 7:
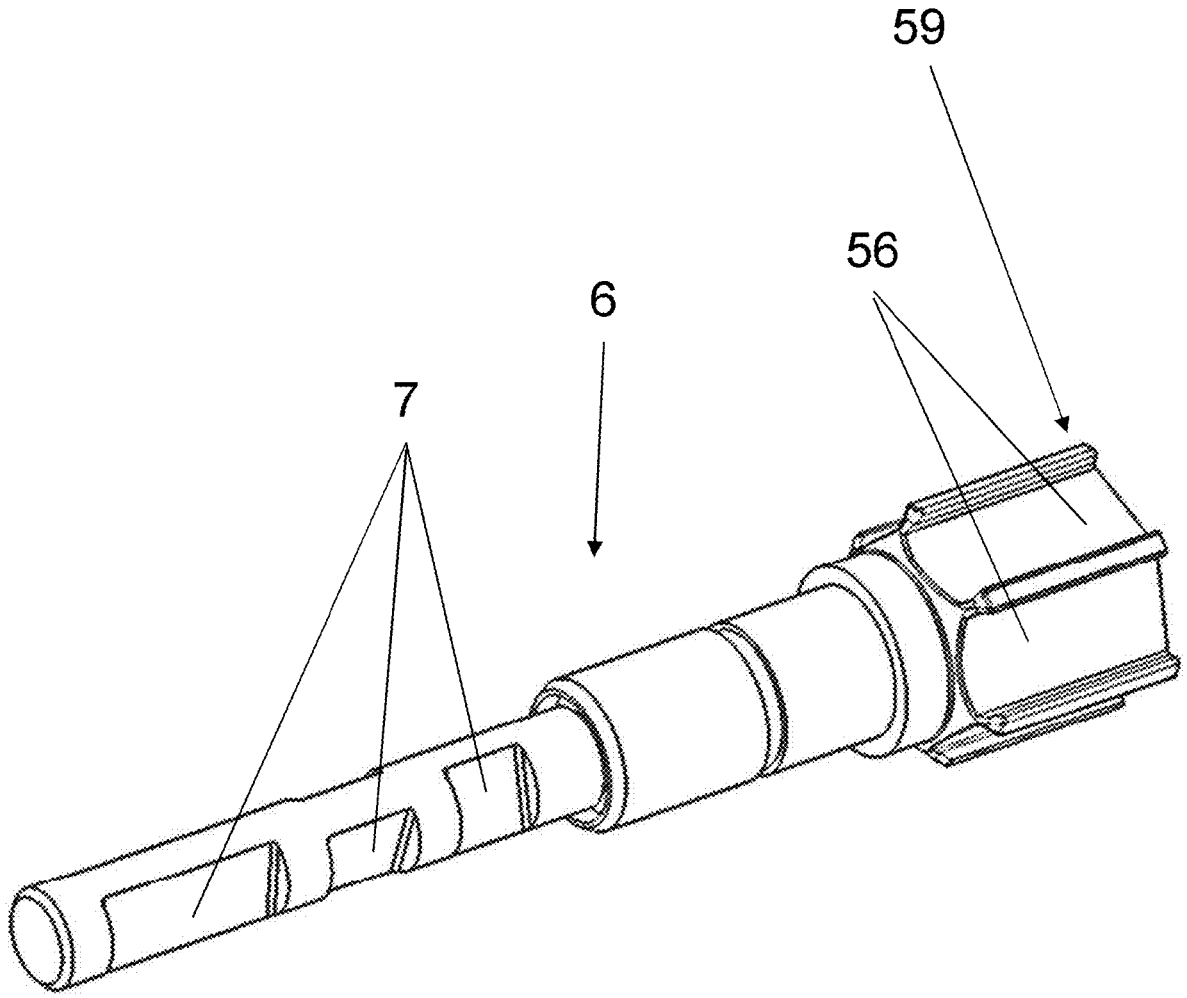
FIG. 7 shows a perspective view of the spool of the radial piston pump of FIG. 2.
Figure 8:
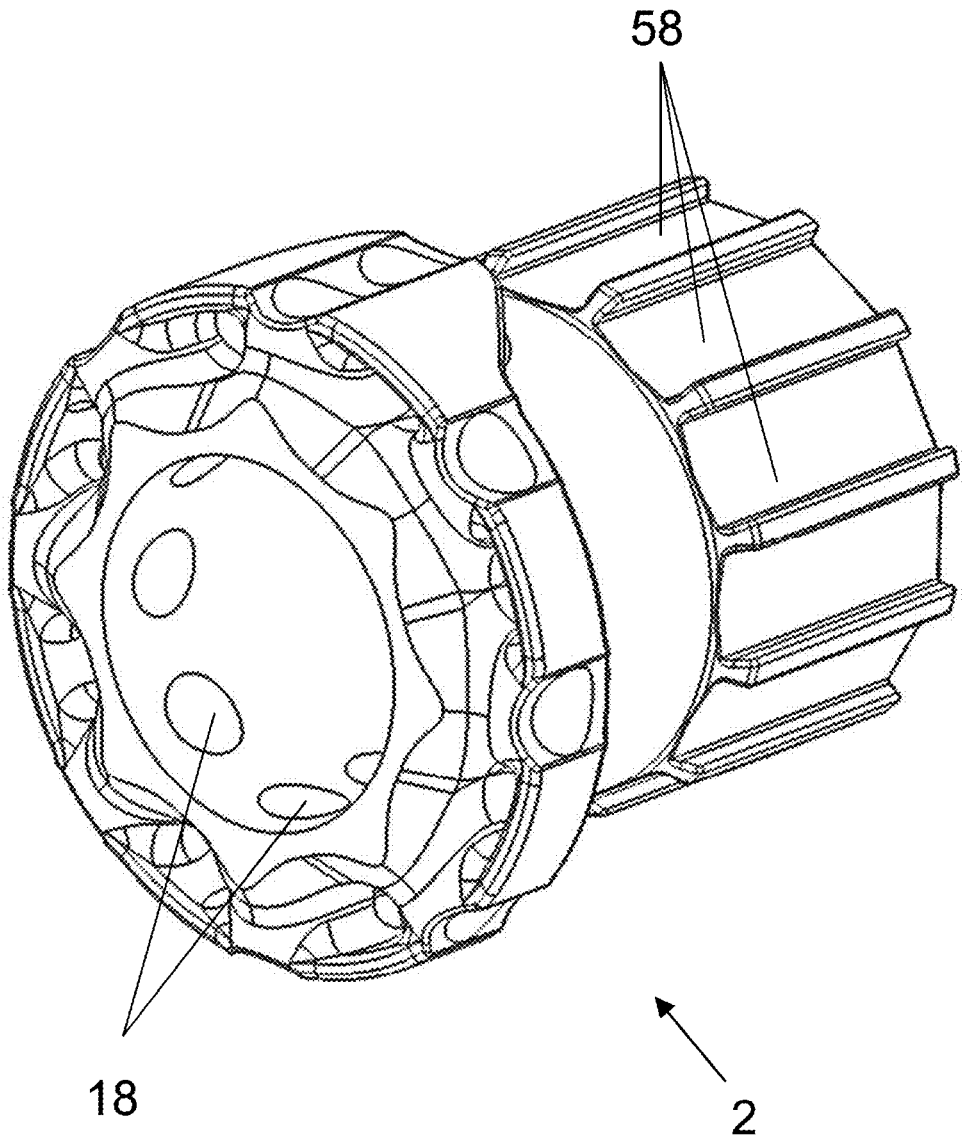
FIG. 8 shows a perspective view of the rotor of the radial piston pump of FIG. 2.

FIGS. 2 and 3 are cross sectional views of a radial piston pump and motor assembly 1. FIGS. 3*a* and 3*b* are both cross section plan views of the radial piston pump and motor assembly 1 of FIG. 2. The assembly 1 comprises a rotor, shown in detail in FIG. 9, 2 mounted on a pintle 4 (which is shown as partially transparent in FIG. 2 in order to aid understanding). A spool 6, shown in detail in FIG. 6, is concentrically located within a cavity 8 defined by an inner surface 10 of the pintle 4. In the present embodiment the spool 6 is an elongate body having a generally circular cross-section, but the surface of the spool is flattened in several regions to provide an indented surface 7. In other embodiments the spool may comprise one or more lands or grooves. One end 59 of the spool 6 protrudes from the pintle 4 and is connected to a control motor 12. In the embodiment of FIG. 2 the control motor 12 comprises a plurality of control motor permanent magnets 14 mounted on splines 56 of the spool 6 for rotation therewith and a plurality of control motor coils 16, said control motor permanent magnets 14 being concentrically located within control motor coils 16. While the present embodiment has permanent magnets concentrically located within an annular array of coils it will be appreciated that other control motor arrangements may be used, for example the coils may be mounted on the rotor, and the permanent magnets on the housing of the pump.

The rotor 2 comprises a plurality of radially extending piston chambers 18, and in use each cavity has a piston 20 located therein. The pistons 20 (and piston chambers 18) are arranged in two layers, the pistons 20*a* of a first layer being spaced apart from the pistons 20*b* of a second layer along the longitudinal axis of the rotor 2. At the distal end of each of the pistons 20 is a cam follower 22. The cam followers 22*a* of the pistons 20*a* of the first layer are arranged to roll along a first cam surface 24*a* and the cam followers 22*b* of the pistons 20*b* of the second layer are arranged to roll along the second cam surface 24*b*. The first cam surface 24*a* and a second cam surface 24*b* extend circumferentially around and face towards the outside of the rotor 2. The first cam surface 24*a* and the second cam surface 24*b* are profiled so that the radial distance between each cam surface 24 and the rotor 2 varies with location around the circumference of the rotor 2. The first cam surface 24*a* and the second cam surface 24*b* therefore have distal regions 26 which are further from the outer surface of the rotor 2 than proximal regions 28. In some embodiments the cam surfaces may have the same profile, in other embodiments the profile of the cam surfaces may differ with respect to each other. While the present embodiment comprises two layers of pistons and two cam surfaces it will be appreciated that in other embodiments more than two layers and/or cam surfaces may be present. A plurality of permanent magnets 30 are mounted on splines 58 and spaced apart around the circumference of the rotor 2 at a location spaced apart along the longitudinal axis of the rotor 2 from the pistons 20. The permanent magnets 30 form part of a motor 32. The motor 32 also comprises an annular array of coils 34, the permanent magnets 30 being concentrically located within the array of coils 34. It will be appreciated that while the present embodiment describes a motor in which the stator comprises a plurality of coils and the rotor comprises an array of permanent magnets other types or motor may be used in embodiments in accordance with the present disclosure provided that the motor comprises a rotor and a stator.

Figure 4:
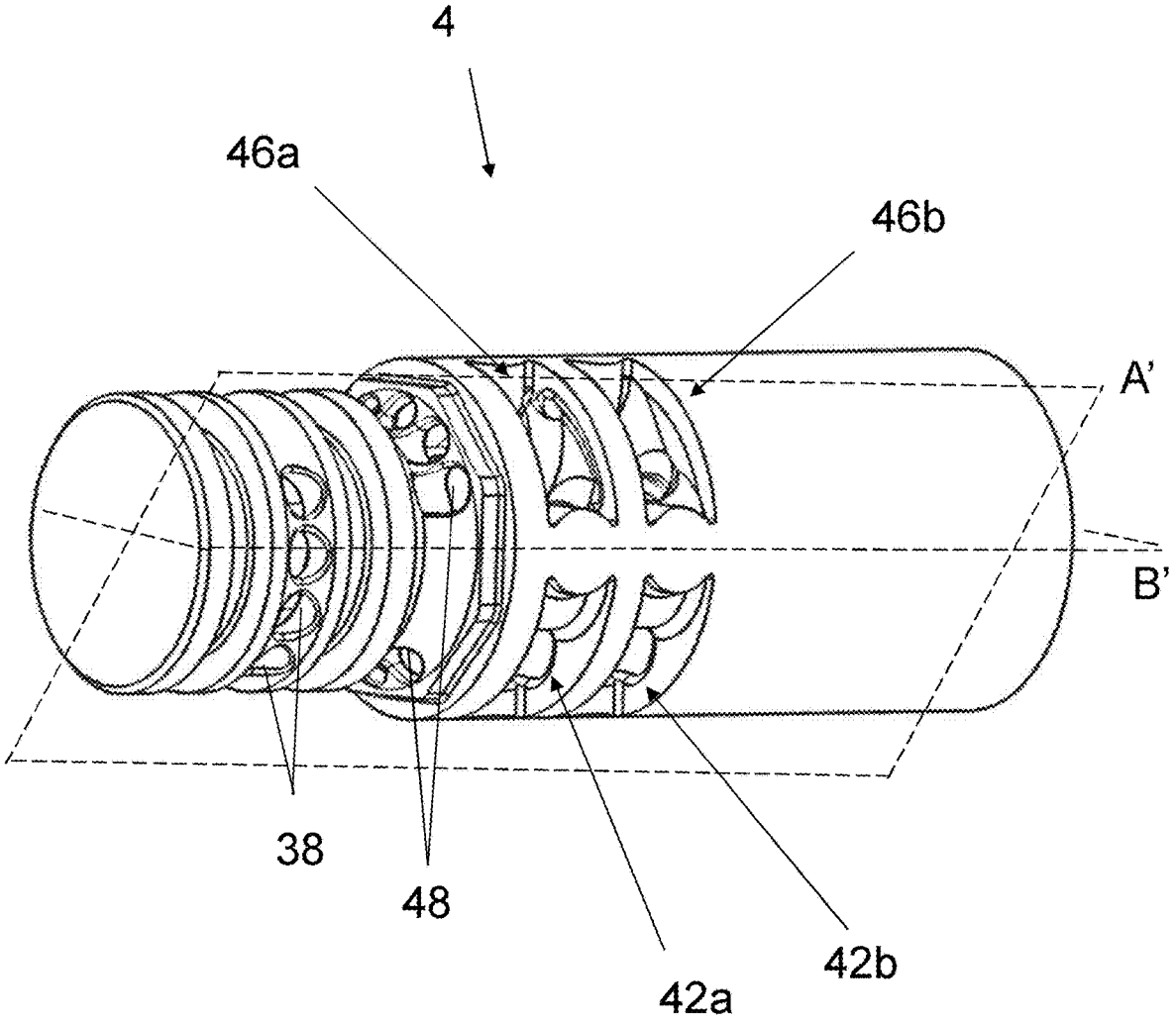
FIG. 4 shows a perspective view of the pintle of the radial piston pump of FIG. 2.
Figure 5A:
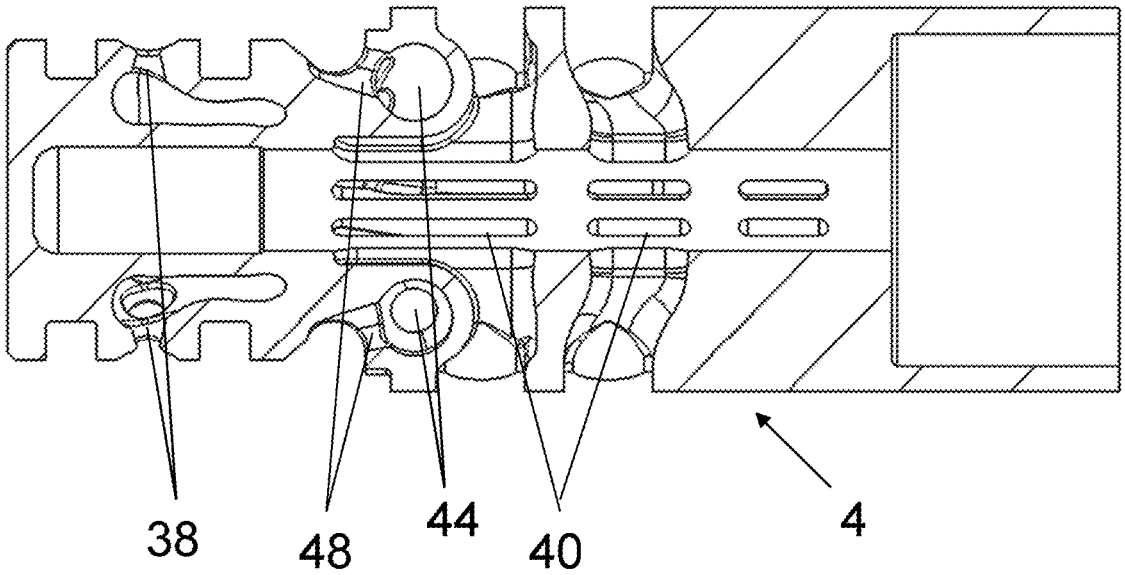
FIGS. 5*a* and 5*b* shows cross-section views of the pintle of FIG. 5.
Figure 5B:
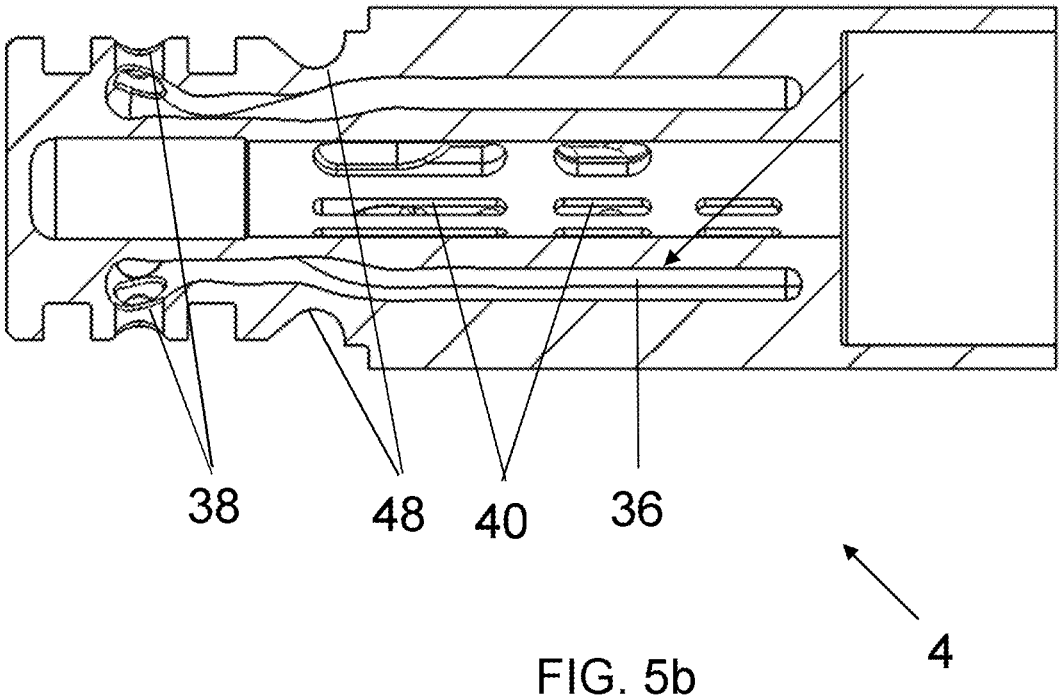

Formed within the pintle 4 (see FIGS. 4 to 6) are: inlet-to-spool flow galleries 36 which provide a flow path between the inlets 38 of the pump (the inlets 38 are located at the opposite end of the pintle 4 to the control motor 12) and the spool 6; spool-to-piston flow galleries 40 which provide a flow path between the spool 6 and a first and/or second piston inlet aperture 42*a*, 42*b*; piston-to-outlet flow galleries 44 which provide a flow path between a first and/or second piston outlet aperture 46*a*, 46*b* and the outlets 48 of the motor-pump-valve assembly 1 (the outlets 48 are located at the opposite end of the pintle 4 to the control motor 12); and return flow galleries which provide a flow path between the spool 6 and outlets 48. Each of the first and second piston inlet apertures 42*a*, 42*b* is in the form of a slot or groove that extends around a portion of the outer circumference of the pintle 4 at the same axial location as the first or second layer of pistons 20*a*, 20*b* respectively. Each of the first and second piston outlet apertures 46*a*, 46*b* is in the form of a slot or groove that extends around a different portion of the outer circumference of the pintle 4 to the first and second piston inlet apertures 42*a*, 42*b*, but again at the same axial location as the first or second layer of pistons 20*a*, 20*b* respectively. Each of the first and second piston inlet apertures 42*a*, 42*b* are located opposite a distal region 26 of the first and second cam surfaces 24 respectively. Each of the first and second piston outlet apertures 46*a*, 46*b* are located opposite a proximal region 28 of the first and second cam surfaces 24 respectively. In the present embodiment, each cam surface 24, comprises two distal regions 26 and two proximal regions 28, the regions being equally spaced in an alternating manner around the outer circumference of the piston. Each layer of the pump comprises two piston inlet apertures 42, and two piston outlet apertures 46, each of said apertures occupying slightly less than ninety degrees of the circumference of the surface of the pintle 4, with like apertures being located on opposite sides of the pintle 4. For the sake of clarity, not all flow galleries are shown in FIGS. 2 and 3.

The components described above are located within a housing 50, the interior of the housing 50 being divided into two concentric portions along the entirety of its length by an interior wall 52. The interior wall 52 extends circumferentially around the rotor 2, separating the rotor 2 (including the permanent magnets 30 and pistons 20) and cam surfaces 24 from the coils 34 and control motor coils 16. Within the housing 50, on the exterior side of interior wall 52, there are wires/cables 54 which are capable of transmitting power and/or control signals to the control motor 12 and the motor 32.

In use, liquid at low pressure enters the pump-motor-valve assembly 1 at inlets 38 and travels via one or more inlet-to-spool flow galleries 36 in pintle 4 to the cavity 8 containing the spool 6. The spool 6 is rotated between different positions by the control motor 12, with the positioning of the spool 6 controlling the flow of fluid by selectively providing one or more flow paths for the fluid across the surface of the spool 6 via indented surfaces 7. Depending on the position of the spool 6, fluid may be directed from the cavity 8 to (i) the pistons 20*a* of the first layer but not the pistons 20*b* of the second layer, (ii) the pistons of the first and second layers 20*a*, 20*b*, (iii) the pistons of the first and second layers 20*a*, 20*b* and the outlets 38 of the pump, or (iv) the outlets 38 of the pump. In the case of (i) and (ii) the spool 6 is positioned such that a flow path is created from inlet-to-spool flow galleries 36 to spool-to-piston flow galleries 40. In the case of (iii) the spool 6 is positioned such that a flow path is created from inlet-to-spool flow galleries 36 to spool-to-piston flow galleries 40 and return flow galleries 49. In the case of (iv) the spool 6 is positioned such that a flow path is created from inlet-to-spool flow galleries 36 to return flow galleries 49. In other embodiments, the spool may be arranged such that for a given position fluid is directed from the cavity 8 to the pistons 20*b* of the second layer but not the pistons 20*a* of the first layer.

In the present embodiment, the provision of electric current to the coils 34 in the presence of the magnetic field produced by permanent magnets 30 generates an electromotive force in the conventional manner, the electromotive force causing the permanent magnets 30 and the rotor 2 to which they are attached to rotate. This rotation of the rotor 2 drives reciprocal motion of the pistons 20 as the motion of the rotor 2 causes cam followers 22 to move along the cam surfaces 24. As the radial distance between the cam surface 24 and the rotor 2 decreases, the cam followers 22 and the pistons 20 to which they are attached are pushed inwards, expelling fluid from the piston chamber 18 via the first and second piston outlet apertures 46*a*, 46*b* to the piston-to-outlet flow galleries 44. As the radial distance between the cam surface 24 and the rotor 2 increases, the pistons 20 (which are biased towards an extended position) move outwards and fluid is drawn into the piston chamber 18 via the first and second piston inlet apertures 42*a*, 42*b* from the spool-to-piston flow galleries 40. In this way, the pressure of the fluid is increased by the action of the pump.

The present embodiment provides a variable displacement pump, where the flow rate from the pump can be varied by controlling whether one or both layers of the pump are in operation. In this way, pumps in accordance with the present disclosure may provide additional flexibility and/or may allow for more efficient operation over a wider range of operating conditions. Additionally and/or alternatively, pumps in accordance with the present embodiment may provide this advantage while being compact and/or mechanically simple in comparison to prior art pumps.

Each cam surface of the present embodiment comprises two proximal regions and two distal regions, resulting in two cycles of motion of the piston for each rotation of the rotor. However, in some embodiments, the number of proximal regions may differ as between different layers of pistons. Further, the profile of the cam surface as between different layers may differ in other ways, for example by having a larger maximum distance between the rotor and cam surface and/or a steep rate of change in said distance. Thus, pumps in accordance with embodiments of the disclosure may allow for a pump to have different characteristics depending on which layer of the pump fluid passes through thereby increasing the flexibility of the pump and/or the efficiency of the pump across a broad range of operating conditions.

Controlling the flow of fluid to the pistons using a spool valve (as in the present embodiment) may facilitate the provision of a more compact pump for a given flow rate and/or allow for a reduction in the part count of the pump thereby reducing weight and/or cost. Additionally or alternatively, use of a spool valve may provide a more responsive pump as the (relatively lightweight) spool can be quickly and precisely displaced to control flow through the pump. However, it will be appreciated that the multi-layer pump can be used with different control systems, either integral with or separate to the motor-pump assembly, provided said control systems are capable of appropriately controlling the flow of fluid to the pistons.

In the present embodiment, the spool 6 is mounted for rotation, and therefore a rotary spool valve, but in other embodiments the spool may move axially.

The rotor 2 of the present embodiment is both the rotor of the motor 32 and the rotor of a radial piston pump comprising pistons 20. Use of such a common rotor in a combined motor-pump may allow for a more compact pump design and/or a more responsive pump. Additionally or alternatively, use of a common rotor may reduce the number of parts in the pump, not only because the pump and motor rotor are integrally formed by because there is no need for shafts and/or gearing to transmit the rotational motion generated by the motor to the rotor of the pump.

In the present embodiment, one or more orifices (not shown) are formed in the surfaces of the pintle. In use, fluid that has been pressurised by the action of the pistons 20 is forced out of these orifices and forms a hydrostatic bearing between the pintle and the rotor. Thus, pumps in accordance with the present embodiment may suffer lower loses due to friction and/or have a longer operational life.

Locating the inlet and outlet to the pump at the same end of the pintle (as in the present embodiment) may facilitate connection of the motor and pump assembly to a hydraulic system. However, it will be appreciated that in other embodiments the inlet and/or outlet may have different locations.

In some embodiments, the interior wall 52 (and associated seals, if necessary) form a water-tight barrier within the housing 50. This allows fluid to flow through and around the rotor 2 while keeping coils 34 and control motor coils 16 dry thereby increasing reliability and simplifying construction of the motor-pump by removing the need to individually protect electrical components from contact with the working fluid.

In some embodiments, a small amount of fluid leaks from piston chambers 18 when the pump is in use. The interior wall 52 may contain features and/or flow galleries that direct this fluid around and/or over the rotor 2 thereby providing a cooling effect. Thus, assemblies in accordance with the present disclosure may allow for improved cooling for the pump and/or motor. Additionally or alternatively, such a cooling effect may be achieved without significantly reducing the efficiency of the pump by taking advantage of the fluid leaking from piston chambers 18.

Figure 9:
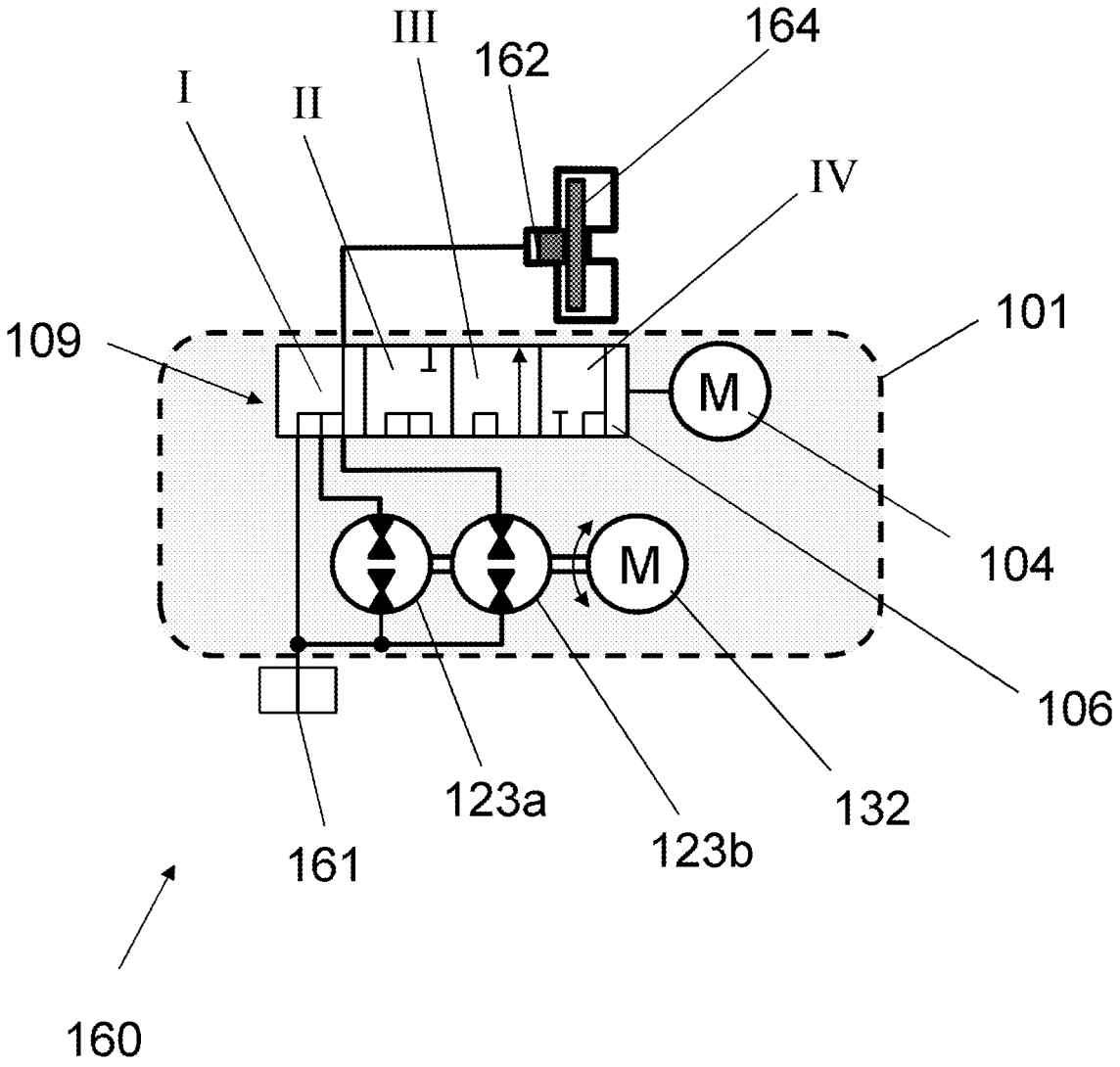
FIG. 9 shows a schematic diagram of a brake system comprising a radial piston pump in accordance with an embodiment of the disclosure.

In an embodiment of the disclosure shown schematically using the customary symbols in FIG. 9, a radial piston pump and motor assembly 101 similar to that described above in connection with FIG. 2 (except where described as otherwise below) is used in a disc brake system 160. Similar components as between FIG. 2 and FIG. 9 are indicated in FIG. 9 with the reference numeral incremented by 100, e.g. the spool 6 of FIG. 2 is indicated with the reference number 106 in FIG. 9. The disk brake system 160 comprises radial piston pump and motor assembly 101 connected via inlets 138 to a fluid reservoir 161, and via outlets 148 to a brake calliper and pad assembly 162 adjacent a brake disk 164. In FIG. 9 a single brake calliper and pad 162 is shown, but it will be appreciated that in other embodiments a brake calliper may be located on both sides of the brake disk. As for FIG. 2, the radial piston pump and motor assembly 101 comprises a spool 106 mounted for rotation in cavity 108 (not shown in FIG. 9) to form a spool valve indicated with reference numeral 109 in FIG. 9. Motion of the spool 106 is provided by control motor 104. Pistons 122*a* of the first layer and pistons 122*b* of the second layer, along with the associated cam followers etc. form first and second pumps 123*a*, 123*b* driven by the motor 132. In contrast to the arrangement of FIG. 2, in the radial piston pump and motor assembly 101 of FIG. 10 the spool valve 109 of FIG. 9 is located downstream of the first and second pumps 123*a*, 123*b*.

As shown in FIG. 9 in the standard schematic manner, the spool valve 109 has four positions (each position corresponding to a different rotational position of the spool 106 within cavity 108). Those positions are labelled I, II, III and IV in FIG. 9. Flow galleries (indicated by lines in FIG. 9) connect (i) the fluid reservoir 161 to each of the first and second pumps 123*a*, 123*b*, (ii) each of the first and second pumps 123*a*, 123*b* to the spool valve 109 and (iii) the spool valve 109 to the fluid reservoir 161 and the brake calliper and pad assembly 162. While the flow galleries are shown schematically as straight lines in FIG. 9 in practice the flow galleries may be curvilinear and extend around and surround a portion of the brake calliper and pad assembly 162.

Mode I may be referred to as a passive mode. In Mode I, the inlet 138, outlet 148 and first and second pumps 123*a*, 123*b* are all connected so that fluid can flow freely via the spool valve 109 between the pumps 123*a*, 123*b*, the reservoir 161 and the brake calliper and pad 162. Mode I may be used when the brake is disengaged and, more particularly, while the motor 132 is spinning up one or both of pumps 123*a*, 123*b* prior to the brake being engaged to allow for faster transmission of hydraulic power to the brake calliper and pad 162 when the brake is eventually engaged (Modes III and IV). Mode I may be used where there is advanced warning that a user is going to brake hard—for instance if a signal is received that a throttle pedal has been sharply disengaged or if a sensor on the car has detected an obstacle. The pumps 123*a*, 123*b* and motor 132 have a greater inertia than the spool valve 109 so may take several milliseconds to spin up to full speed, in contrast the spool valve 109 can switch positions almost instantaneously. By taking advantage of the responsiveness of the spool valve, to switch between a passive and active modes, pumps in accordance with the present embodiment may allow for more responsive braking. It will be appreciated that this mode of operation may be used in other systems, apart from braking systems that would similarly benefit from faster provision of hydraulic power.

Mode II may be referred to as a bypass mode. In Mode II the spool 109 provides a flow path between both first and second pumps 123*a*, 123*b* and the fluid reservoir 161. When the motor 132 drives one or both of the first and second pumps 123*a*, 123*b* fluid is pumped back to the reservoir 161, but not to the brake calliper and pad assembly 162. The resulting flow of fluid may be used to cool the brake system 160 when the brake is not engaged.

Mode III may be referred to as partial operation. In Mode III the spool provides a flow path between the first pump 123*a* and the brake calliper and pad assembly 162 but not between the second pump 123*b* and the brake calliper and pad assembly 162, with the second pump 123*b* being connected to the reservoir 161. Thus, in Mode III only a single layer of the radial piston pump and motor assembly 101 is providing hydraulic power to the brake system 160.

Mode IV may be referred to as full operation. In mode IV the spool provides a flow path between both the first and second pumps 123*a*, 123*b* and the brake calliper and pad assembly 162. No flow path between the pumps 123*a*, 123*b* and the reservoir 161 is provided. Thus, in Mode IV both layers of the radial piston pump and motor assembly 101 are providing hydraulic power to the brake system 160. Mode IV is used when more hydraulic power is required than can be provided in Mode III. The ability to selectively use the layers of the radial piston pump and motor assembly 101 allows the assembly 101 to achieve high flows when necessary, but to operate more efficiently at lower flows.

Figure 12:
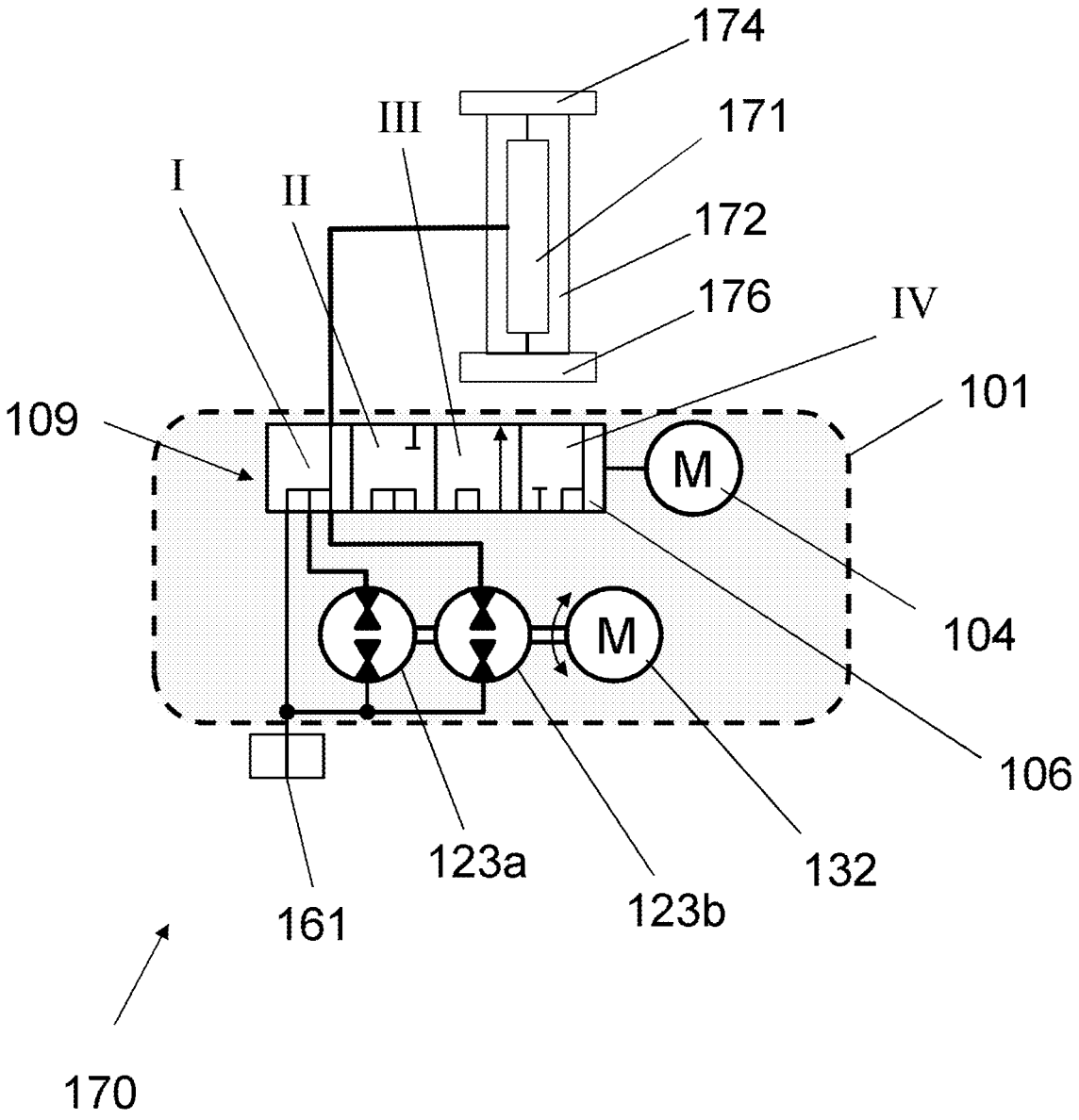
FIG. 12 shows a schematic diagram of an active suspension system comprising a radial piston pump in accordance with an example embodiment of the disclosure.

FIG. 12 shows a variation of the embodiment of FIG. 9, where a radial piston pump and motor assembly 101 similar to that described above in connection with FIG. 2 (except where described as otherwise below) is used in an active suspension system 170. Similar components as between FIG. 9 and FIG. 12 are indicated in FIG. 12 with the same reference numeral. Only those aspects of the FIG. 12 embodiment which differ with respect to the FIG. 9 embodiment are discussed here. In FIG. 12, the suspension system 170 comprises radial piston pump and motor assembly 101 connected via inlets 138 to a fluid reservoir 161, and via outlets 148 to an actuator 171 concentrically located with a coil spring 172. The actuator 171 is connected to the chassis 174 (indicated schematically in FIG. 12) of a car (not shown) at one end and to a wheel 176 (indicated schematically in FIG. 12) of the car at the other end. In other embodiments coil spring 172 may be absent.

In use, power is supplied to actuator 171 so that actuator 171 can be used to vary the damping of the movement between chassis 174 and wheel 176. Mode I (passive mode) may be used when a sensor detects an obstacle on the road and allows the pump to be 'spun up' so that power draw from the engine may be more effectively managed. Modes III and IV are used depending on how much power is required by the actuator (e.g. the amount of damping required) and Mode II may be used to cool the pump when the system is not engaged.

Figure 13:
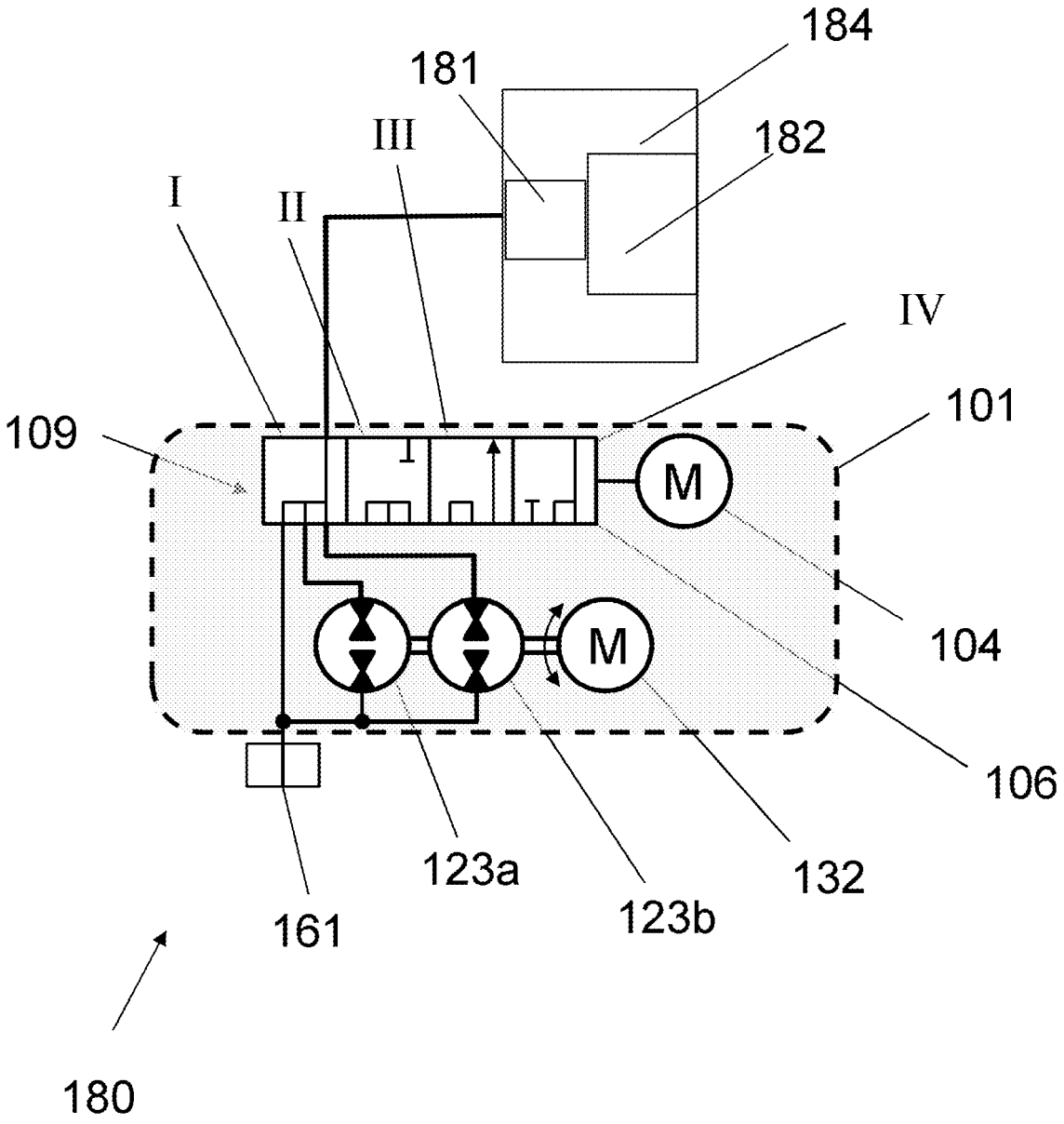
FIG. 13 shows a schematic diagram of a flight control system comprising a radial piston pump in accordance with an example embodiment of the disclosure.

FIG. 13 shows a variation of the embodiment of FIG. 9, where a radial piston pump and motor assembly 101 similar to that described above in connection with FIG. 2 (except where described as otherwise below) is used in a flight control system 180. Similar components as between FIG. 9 and FIG. 13 are indicated in FIG. 13 with the same reference numeral. Only those aspects of the FIG. 13 embodiment which differ with respect to the FIG. 9 embodiment are discussed here. In FIG. 13, the flight control system comprises radial piston pump and motor assembly 101 connected via inlets 138 to a fluid reservoir 161, and via outlets 148 to an actuator 181 connected to a control surface 182 mounted on a portion of a wing 184 of an aircraft (not shown).

In use, fluid is provided to actuator 181 so that actuator 181 an move control surface 182 thereby changing the aerodynamic performance of wing 184. Mode I (passive mode) may be used to 'spin up' the pump in advance of a manoeuvre so that power requirements within the aircraft can be managed efficiently. Modes III and IV are used depending on how much power is required by the actuator to move the flight control surface 182, and Mode II may be used to cool the pump when the system is not engaged.

Figure 1:
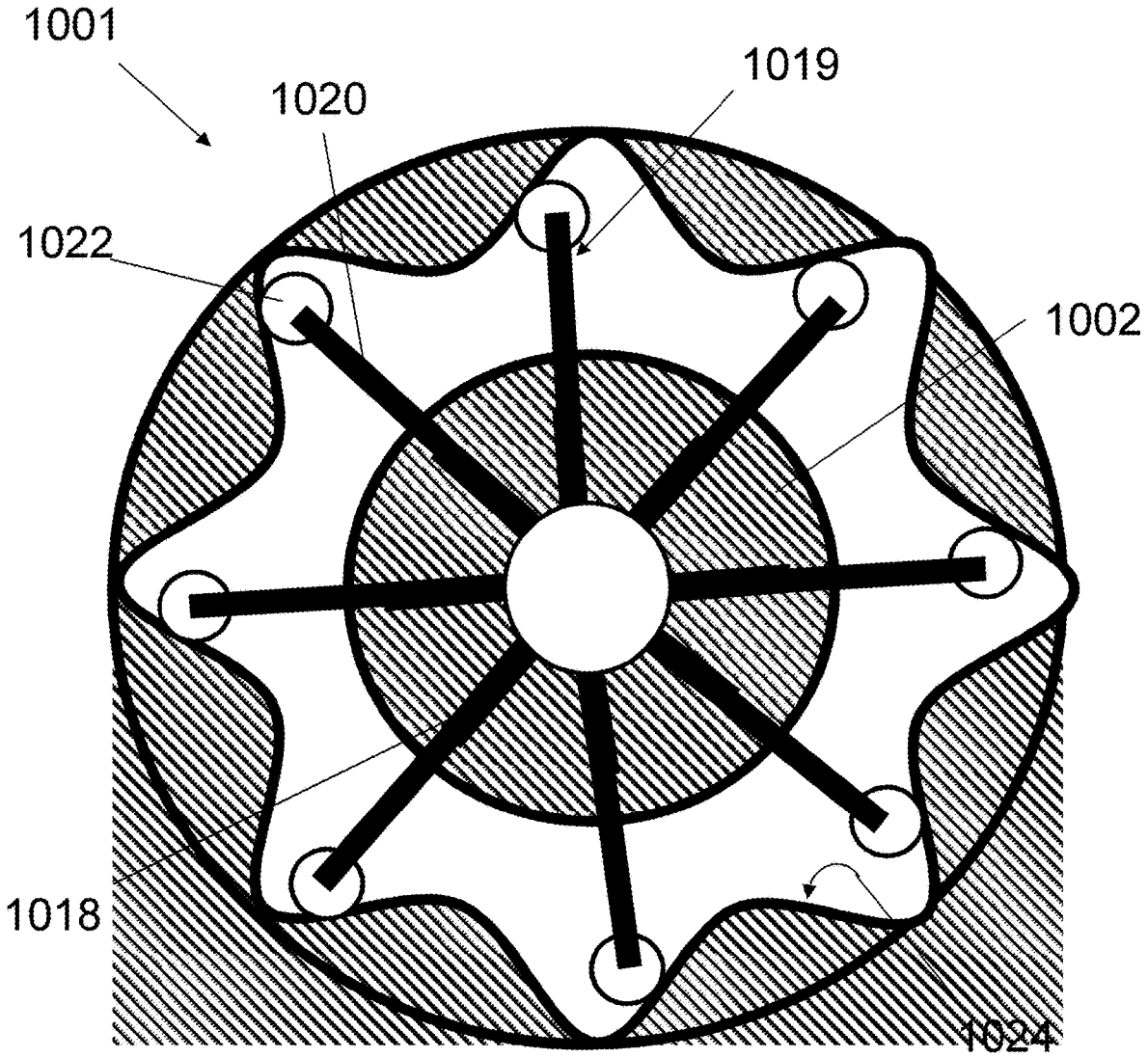
FIG. 1 PRIOR ART
FIG. 1 shows a section view of a prior art radial piston pump.
Figure 10A:
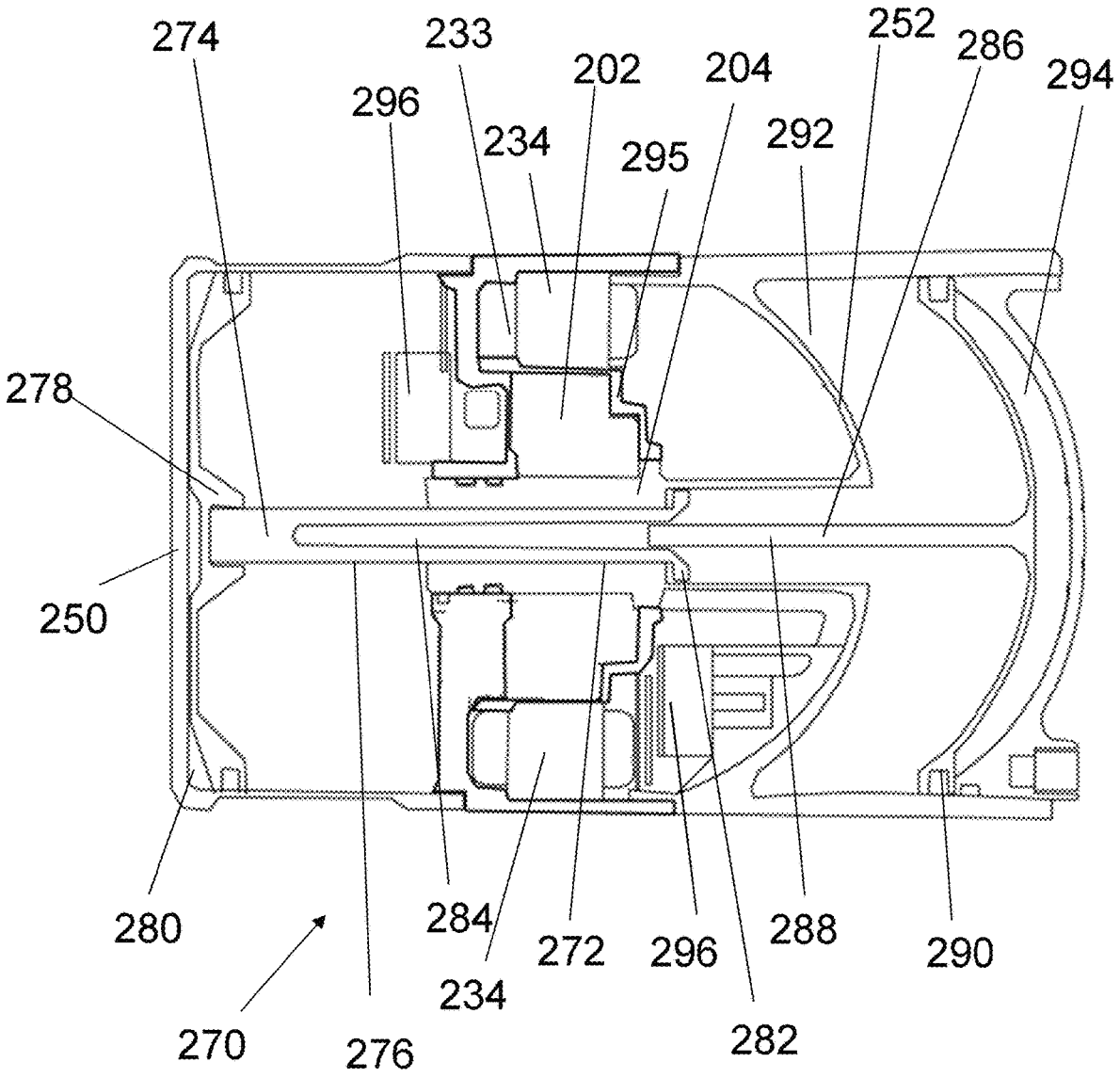
FIGS. 10*a* and 10*b* show cross sectional views of a power pack according to an embodiment of the disclosure.
Figure 10B:
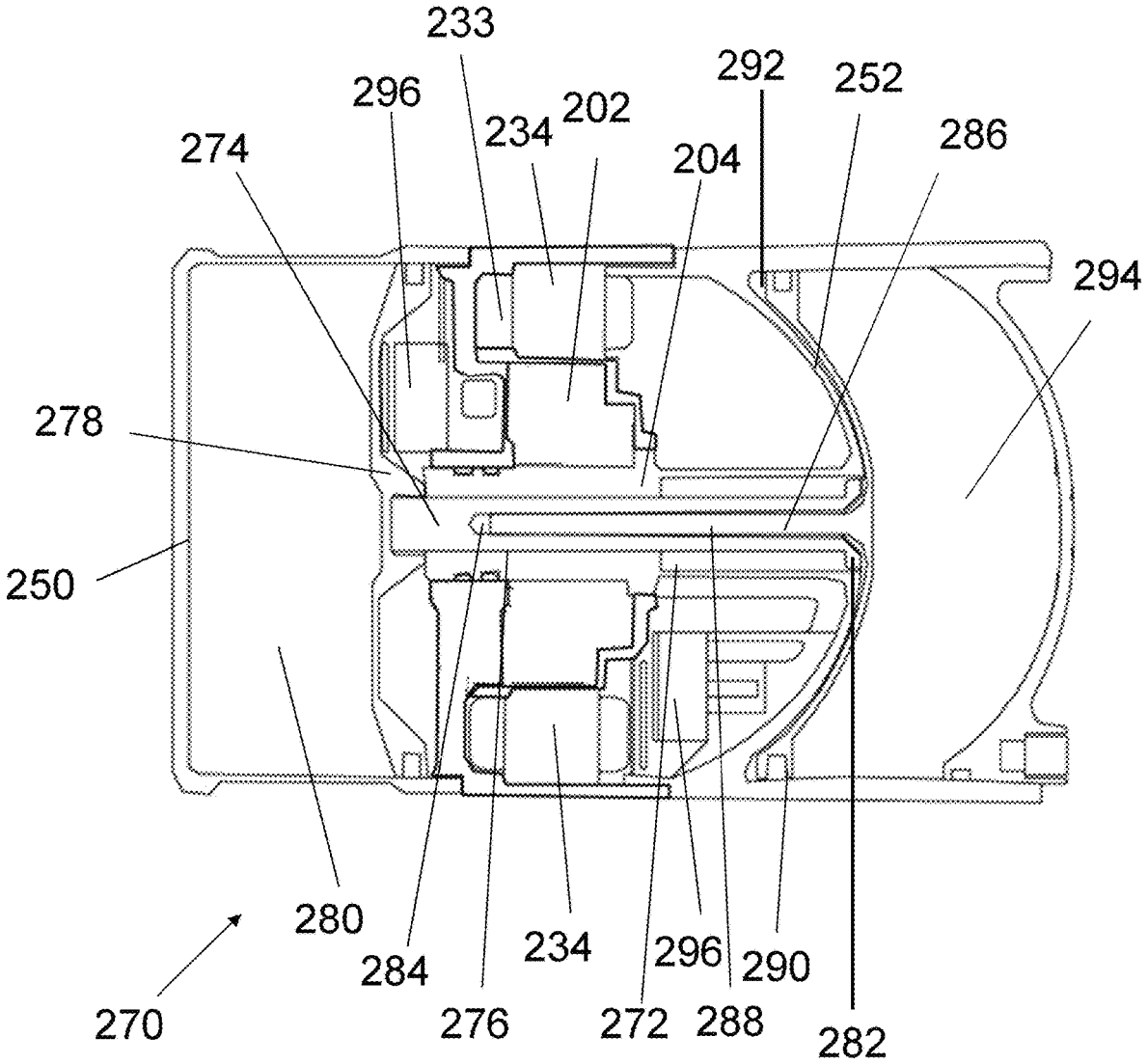

FIGS. 10*a* and 10*b* show a cross-sectional view of a hydraulic power pack 270 in accordance with an example embodiment of the disclosure in (a) a reservoir empty/accumulator full configuration and (b) a reservoir full/accumulator empty configuration. Similar components as between FIG. 2 and FIG. 10 are indicated in FIG. 10 with the reference numeral incremented by 200, e.g. the rotor 2 of FIG. 2 is indicated with the reference number 202 in FIG. 10. The power pack housing 250 contains a pintle 204, with a rotor 202 mounted thereon. The pintle 204 is connected to the housing 250 by an interior wall 252 that extends radially inward from the housing 250 to the pintle 204 and appears dome-shaped when viewed in cross section in FIG. 10, with the convex surface of the dome facing towards the right hand side of FIG. 10 and the distal end of the pintle 204 being on the left hand side of Fig. Located concentrically with and outside the rotor 202 is the stator 233 of motor 232. The rotor 202 comprises a plurality of pistons (not shown) that together with rotor 202 form a radial piston pump 223 (for example having multiple layers of pistons as described in FIG. 1 or having only a single layer of pistons). In contrast to the FIG. 2 embodiment, the hydraulic power pack does not have a spool configured to control the flow of fluid in the pump. Extending through an axial through-hole 272 in pintle 204 is the stem 274 of a fluid reservoir piston 276. At one end (the left hand end of FIG. 10) of the stem 274 is a reservoir piston head 278 which fits within a cylindrical portion of housing 250 to form a fluid reservoir 280 on the far side of the reservoir piston head 278 to the motor stator 233 and rotor 202 between the reservoir piston head 278 and an end portion of housing 250. At the other of the stem 274 is a circumferential flange 282 which extends radially outward from the stem 274. A recess 284 extends into the stem 274 along its longitudinal axis from the end of the stem having the circumferential flange 282. The stem 286 of an accumulator piston 288 is located in the recess 284. The accumulator piston 288 has an accumulator piston head 290 at one end of the stem 286 (the end located on the right hand side of FIG. 10) which fits within a cylindrical portion of the housing 250 to form a pressure accumulator 292 on the near side of the accumulator piston head 290 to the to the motor stator 233 and rotor 202 (i.e. between the convex surface of the interior wall 252 and the piston head 290). On the far side of the accumulator piston head 290, relative to the motor stator 233 and rotor 202, a gas reservoir 294 is formed between the accumulator piston head 290 and an end portion of housing 250. Control valves 296 are located between the reservoir piston head 278 and the motor stator 233 and rotor 202, and between the inner wall 252 and the motor stator 233 and rotor 202. In FIG. 10(*a*) the fluid reservoir 280 is empty and the accumulator is substantially full; the reservoir piston head 278 is immediately adjacent the end portion of housing 250 and accumulator piston head 290 is adjacent the opposite end portion of housing 250 such that the volume of gas reservoir 294 is relatively small. In FIG. 10(*b*) the fluid reservoir 280 is full and the accumulator is empty; the reservoir piston head 278 is spaced apart from the end portion of housing 250 that defines the fluid reservoir 280 and the accumulator piston head 290 is adjacent inner wall 52 such that the volume of gas reservoir 294 is relatively large. A membrane wall 295 provides a fluid-tight barrier separating the motor stator 233 and rotor 202.

Figure 11:
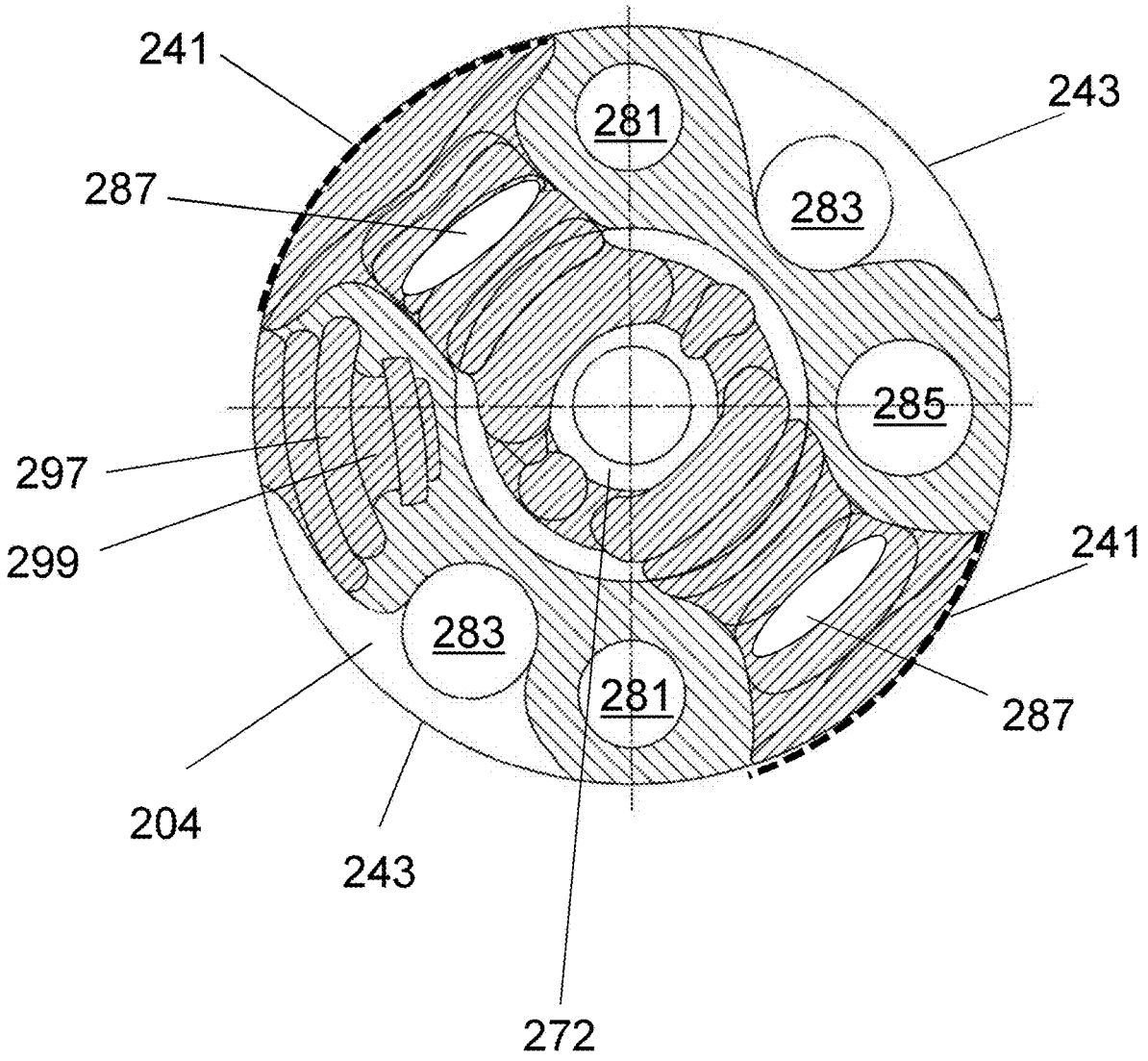
FIG. 11 shows a cross sectional view of the pintle of the power pack of FIG. 10.

FIG. 11 shows a cross-sectional schematic view of pintle 204 of FIG. 10. At the centre of pintle 204 is axial through-hole 272 having stem 274 of fluid reservoir piston 276 and stem 286 of accumulator piston 288 received therein. A number of flow galleries which appear substantially circular when viewed in cross-section in FIG. 11 are formed along the longitudinal axis of pintle 204. These include (in order travelling clockwise from a 12 o'clock position in FIG. 11): ancillary pressure flow gallery 281, pump outlet flow gallery 283, control valve return flow gallery 285, pump inlet flow gallery 287, control valve pressure flow gallery 281, pump outlet flow gallery 283 and pump inlet flow gallery 287, with flow galleries of the same type being located opposite each other around the circumference of the pintle 204. Pump inlet flow galleries 287 are also present in stem 274 of fluid reservoir piston 276. Two pump inlet flow apertures 241

(denoted with a dashed line in FIG. 11) are formed in the outer circumference of the pintle 204 and are connected to pump inlet flow gallery 287 at a plane spaced apart from the plane of cross section in FIG. 11. The cross-sectional shape of each pump inlet flow gallery 287 changes in the region adjacent to pump inlet flow aperture 241, expanding from a circle to meet aperture 287 which extends around 80 degrees along the outer circumference of the pintle 204. A pump outlet aperture 243 is similarly connected to each pump outlet flow gallery 283. An anti-rotation device 297 and rotation sensor 299 are also located in the pintle 204.

In use, fluid at low pressure is held in the fluid reservoir 280. Fluid from the fluid reservoir 280 is drawn through pump inlet flow galleries 287 in the reservoir piston head 278 and stem 274, and in pintle 204 (see FIG. 11) to the pump 223 via pump inlet flow apertures 241. Rotation of the pump is caused by supplying current to the coils (not shown) of the motor stator 233. The fluid is pressurised in pump 223 by the action of reciprocating pistons (as described above for FIG. 1) and then passes through pump outlet apertures 243 to pump outlet flow galleries 283 in pintle 204 and inner wall 252 to the pressure accumulator 292. The accumulation of pressurised fluid in pressure accumulator 292 exerts a pressure on accumulator piston head 290 causing the accumulator piston 288 to move towards the right hand side of FIG. 11 and to compress the gas in gas reservoir 294. Fluid in pressure accumulator 292 also exert a force on the surface of circumferential flange 282 that causes fluid reservoir piston 276 to move towards the left hand side of FIG. 10 thereby compressing and increasing the pressure of the fluid in the fluid reservoir 280. Pressurised fluid from pump 223 is also supplied to control valves 296 via ancillary pressure flow galleries 281, and fluid from control valves 296 is returned to fluid reservoir 280 via, control valve return flow gallery 285.

The use of a common rotor for the pump and motor of a hydraulic power pack may allow for a more compact power pack in comparison to power packs of similar capacity. Additionally or alternatively, use of the pintle to provide flow galleries connecting the reservoir, accumulator and pump of the hydraulic power pack may allow for a more compact power pack in comparison to power packs of similar capacity.

In the present example embodiment, the pintle acts as a fluid manifold connecting the reservoir, accumulator and pump, which may provide a more compact power pack in comparison to power packs of similar capacity. In the present example embodiment, the pintle further acts as a fluid manifold for control valves present within the hydraulic power packs due to the inclusion of pressure and return flow galleries for such valves within the pintle. This may provide a more compact power pack in comparison to power packs of similar capacity and/or allow for provision of a self-contained control unit for the hydraulic system to which the power pack is connected, said self-contained control unit being able to provide both a flow of pressurised fluid and control flows. By retaining the "smart" elements of the hydraulic system in the self-contained control unit, design of the hydraulic system may be simplified.

In the same or yet further embodiments the pintle may act as a fluid manifold for control valves located outside the hydraulic power pack and/or other auxiliary systems of the hydraulic system.

While the present disclosure has been described and illustrated with reference to particular embodiments, it will be appreciated by those of ordinary skill in the art that the disclosure lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as preferable, advantageous, convenient or the like are optional and do not limit the scope of the independent claims. Moreover, it is to be understood that such optional integers or features, while of possible benefit in some embodiments of the disclosure, may not be desirable, and may therefore be absent, in other embodiments.

What is claimed is:

1. A radial piston pump comprising a rotor mounted for rotation on a pintle, the rotor comprising a plurality of piston chambers, a piston being mounted in each of the chambers for reciprocal movement, the pump comprising:

at least one supply flow path which, in use, connects one or more of the plurality of piston chambers to a supply of low-pressure fluid, at least one exit flow path via which, in use, high-pressure fluid from one or more of the plurality of piston chambers leaves the pump; and at least one auxiliary flow path which connects another component of the pump to one or more of the plurality of piston chambers, wherein the pintle comprises a plurality of flow galleries comprising at least one supply flow gallery forming part of the supply flow path, at least one exit flow gallery forming part of the exit flow path and at least one auxiliary flow gallery forming part of the auxiliary flow path.

2. A radial piston pump according to claim 1, further comprising a return flow path connected to an outlet of the another component of the pump such that, in use, fluid leaves the another component and/or the pump via the return flow path and the plurality of flow galleries comprises at least one return flow gallery forming part of the return flow path.

3. A radial piston pump according to claim 1, wherein the plurality of flow galleries are integrally formed with the pintle.

4. A radial piston pump according to claim 1, wherein the plurality of flow galleries are present at a same axial position on the pintle.

5. A radial piston pump according to claim 1, wherein the another component of the pump is a control valve, and the auxiliary flow path is, in use, connected to a pressure inlet of the control valve.

6. A radial piston pump according to claim 5, wherein the control valve is a servo valve, and the pump is configured to provide a first and/or second service flow to an actuator or other hydraulic component connected to the pump.

7. A hydraulic power pack comprising a radial piston pump according to claim 1.

8. A hydraulic power pack according to claim 7, further comprising a reservoir and an accumulator, the power pack being configured such that, in use, low-pressure fluid from the reservoir is supplied to the pump and high-pressure fluid from the pump is supplied to the accumulator.

9. A hydraulic power pack according to claim 7, further comprising:

a fluid reservoir piston which defines, at least in part, a fluid reservoir; and an accumulator piston which defines, at least in part, the accumulator, wherein the fluid reservoir piston, an accumulator piston and the rotor are concentric.

10. A hydraulic power pack according to claim 9, wherein the rotor is mounted for rotation on a pintle and at least a portion of the fluid reservoir piston and/or accumulator piston is received within a piston recess formed within the pintle.

11. A hydraulic power pack according to claim 7, configured such that force generated by the high-pressure fluid in the accumulator is transmitted to the low-pressure fluid in the reservoir via the fluid reservoir piston.

12. A brake system for a vehicle, the brake system comprising a radial piston pump in accordance with claim 1.

13. A brake system according to claim 12, further comprising a brake pad and an actuator configured to move the brake pad from a first position to a second position in order to effect braking of a wheel of the vehicle and a fluid reservoir for storing low-pressure fluid, and wherein the brake system is configured such that in use, low-pressure fluid from the reservoir is supplied to the pump and high-pressure fluid from the pump is supplied to the actuator.

14. An active suspension system for a vehicle, the active suspension system comprising a radial piston pump in accordance with claim 1.

15. An active suspension system according to claim 14, the system comprising an actuator, the actuator being configured to exert a force on a wheel and/or chassis of a vehicle, and wherein the active suspension system is configured such that in use, high-pressure fluid from the pump is supplied to the actuator.

16. A flight control system for an aircraft, the flight control system comprising a radial piston pump in accordance with claim 1.

17. A flight control system according to claim 16, further comprising an actuator and a control surface, the actuator being configured to move the control surface from a first position to a second position in order to change an aerodynamic performance of the control surface, and wherein the flight control system is configured such that in use, high-pressure fluid from the pump is supplied to the actuator.

18. A method of manufacturing a radial piston pump according to claim 1, wherein the method comprises producing one or more of the rotor, pintle and/or spool using an additive manufacturing process.

19. A method of manufacturing a radial piston pump according to claim 18, wherein the method comprises finishing a rotor, pintle and/or spool produced using an additive manufacturing process using a subtractive manufacturing process.

20. A method of operating a radial piston pump comprising a rotor mounted for rotation on a pintle, wherein:

the rotor comprises a plurality of piston chambers, a piston being mounted in each of the plurality of piston chambers for reciprocal movement;

fluid flows along at least one supply flow path from a supply of low-pressure fluid to one or more of the plurality of piston chambers;

high-pressure fluid from one or more of the plurality of piston chambers leaves the pump via at least one exit flow path;

high-pressure fluid from one or more of the plurality of piston chambers flows to another component of the pump via at least one auxiliary flow path and is used in an operation of the component; and fluid on the at least one supply flow path, the at least one exit flow path and the at least one auxiliary flow path flows through one or more flow galleries in the pintle.

21. A radial piston pump comprising a rotor mounted for rotation on a pintle, the rotor comprising a plurality of piston chambers, a piston being mounted in each of the chambers for reciprocal movement, the pump comprising:

at least one supply flow path which, in use, connects one or more of the plurality of piston chambers to a supply of low-pressure fluid;

at least one exit flow path via which, in use, high-pressure fluid from one or more of the plurality of piston chambers leaves the pump;

at least one auxiliary flow path which connects another component of the pump to one or more of the plurality of piston chambers; and a return flow path connected to an outlet of the another component of the pump such that, in use, fluid leaves the another component and/or the pump via the return flow path, wherein the pintle comprises a plurality of flow galleries comprising at least one supply flow gallery forming part of the supply flow path, at least one exit flow gallery forming part of the exit flow path, at least one auxiliary flow gallery forming part of the auxiliary flow path and at least one return flow gallery forming part of the return flow path.

* * * * *